United States Patent [19]

Conway et al.

[11] 4,324,335

[45] Apr. 13, 1982

[54] METHOD AND APPARATUS FOR MEASURING THE SURFACE SIZE OF AN ARTICLE

[75] Inventors: Tim D. Conway, El Cerrito; Paul F. Paddock, Riverside, both of Calif.

[73] Assignee: Sunkist Growers, Inc., Sherman Oaks, Calif.

[21] Appl. No.: 122,449

[22] Filed: Feb. 19, 1980

Related U.S. Application Data

[62] Division of Ser. No. 917,724, Jun. 21, 1978, Pat. No. 4,246,098.

[51] Int. Cl.[3] ..... B07C 5/342

[52] U.S. Cl. ..... 209/586; 209/587; 209/914; 250/560; 356/380

[58] Field of Search ..... 209/576, 577, 586, 587, 209/914; 250/560; 356/379, 380

[56] References Cited

U.S. PATENT DOCUMENTS 3,545,610 12/1970 Kelly et al. ..... 209/587

4,147,619 4/1979 Wassmer et al. ..... 209/914

*Primary Examiner*—Joseph J. Rolla

*Attorney, Agent, or Firm*—Fulwider, Patton, Rieber, Lee & Utecht

[57] ABSTRACT

A method and apparatus for grading and sorting articles, particularly fruit, according to size, surface blemish and surface color. Fruit is passed sequentially through a camera array which scans the surface of each fruit and measures the intensity of light reflected from successive discrete surface segments. Significant differences between such measured intensities are detected and a measurement of surface blemish is generated in accordance therewith. Size measurements are derived by counting the total number of segments in the surface of each fruit. Color measurements are derived by averaging the ratio of red light intensity to infrared light intensity reflected from each of a plurality of surface areas of each fruit. The fruit are separated and delivered to separate receivers by a mechanism responsive to the size, blemish and color measurements of the respective fruit.

14 Claims, 19 Drawing Figures

2
53
25
21
41
29
27

31, 33
25
61
45
55
45
61
31, 33
57
47
57
21
31, 33
57
3a
57
55
55
61
45
45
59
61
77, 78
3a
31, 33

Fig. 3a
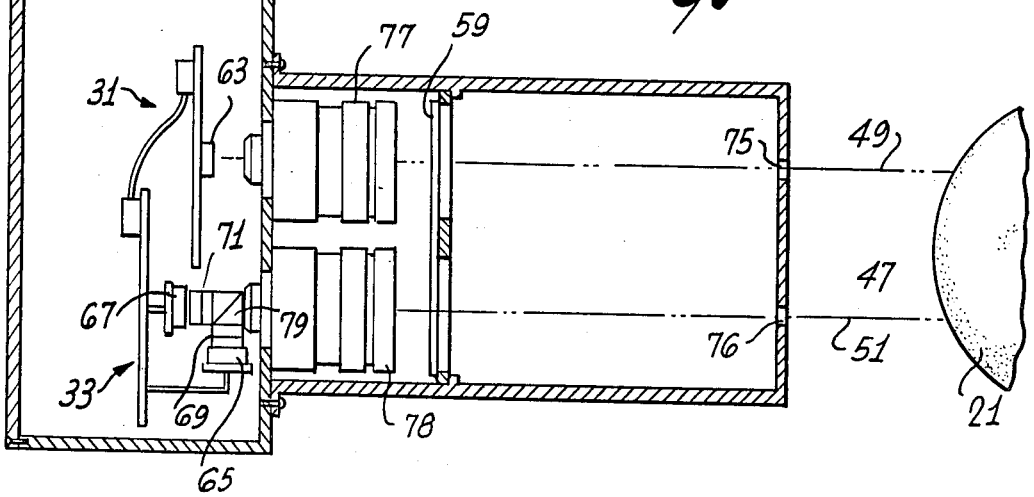
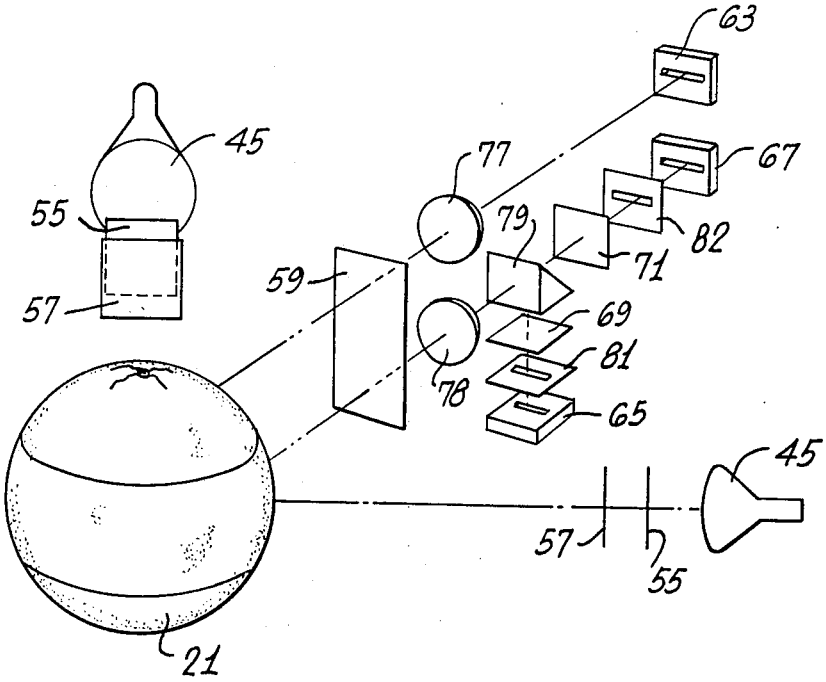
Fig. 3b

DEMULTIPLEXER

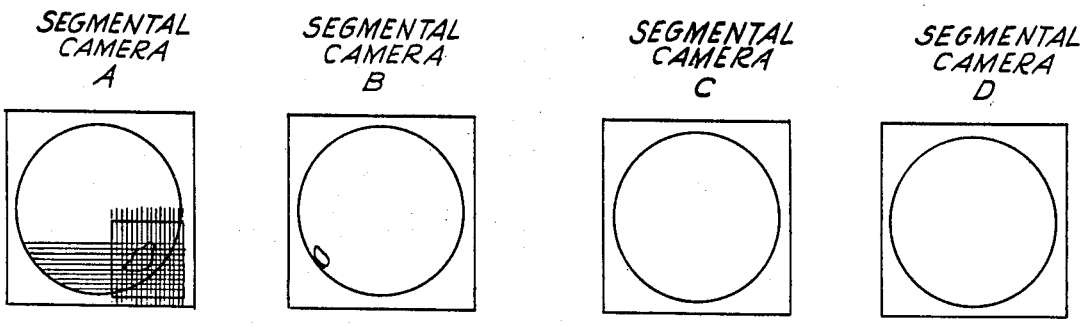
Fig. 8
Fig. 9
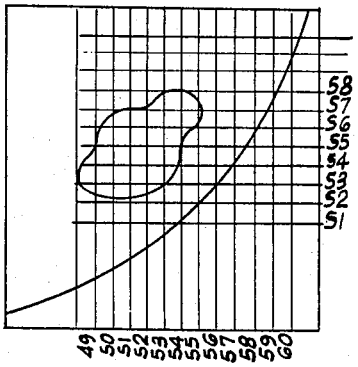
Fig. 10
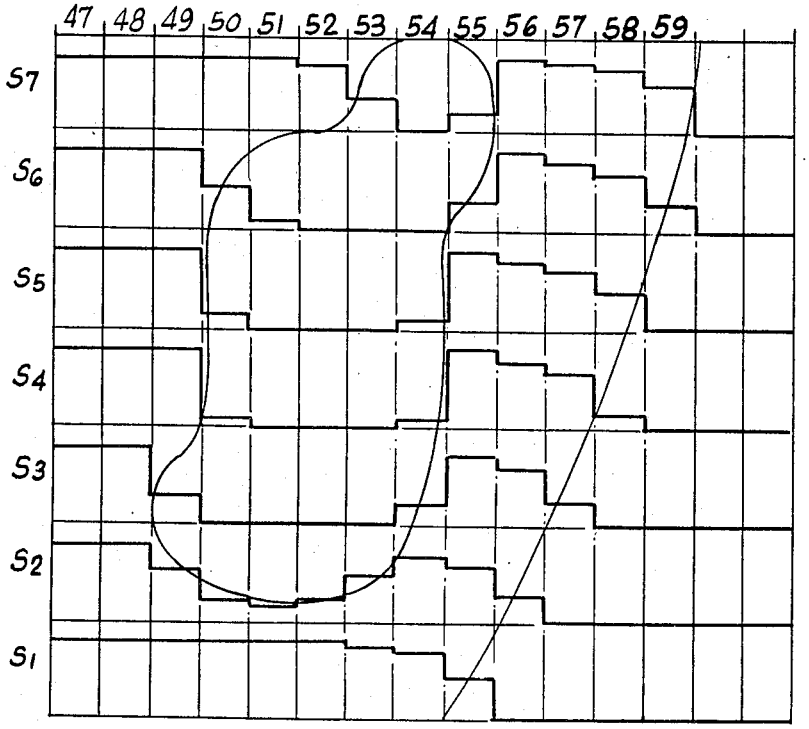

METHOD AND APPARATUS FOR MEASURING THE SURFACE SIZE OF AN ARTICLE

This is a division, of application Ser. No. 917,724, filed June 21, 1978, now U.S. Pat. No. 4,246,098.

BACKGROUND OF THE INVENTION

The present invention relates generally to sorting apparatus and, more particularly, to apparatus for automatically grading and sorting articles, especially fruit, according to size, surface blemish and surface color.

The grading and sorting of fruit is a major cost factor for the fresh fruit industry. In the past, most grading and sorting has been performed by human labor, involving the visual inspection of each fruit and the manual depositing of such fruit into a number of separate receivers in accordance with a worker's assessment of the fruit's proper grade category.

In addition to being a slow process, manual grading and sorting of fruit has proven to be further deficient in that the workers' grading assessments are highly subjective, varying both with time and from worker to worker. Moreover, a single blemish or discolored area on one side of a fruit can occasionally escape detection during manual sorting.

Because of these deficiencies in the manual grading and sorting of fruit, there have been a number of attempts in the past to automate the grading and sorting process. Studies have been made, such as that described in U.S. Pat. No. 2,933,613 to J. B. Powers entitled "Method and Apparatus for Sorting Objects According to Color," which indicate that a measure of the surface color of fruit can be derived by computing a ratio of the intensity of reflected light having a first wavelength to the intensity of reflected light having a second wavelength. Accordingly, devices have been constructed and used for measuring the ratio of red light intensity to infrared light intensity received from the fruit surface. However, such devices have typically provided only a single measurement for each fruit, and have done so by inspecting only one side of the fruit. Since fruit can typically have contrasting colors for different portions of their surfaces, these devices have not been entirely successful.

Other studies have been made, such as that described in U.S. Pat. No. 3,867,041 to G. K. Brown et al entitled "Method for Detecting Bruises in Fruit," which indicate that bruised fruit reflect light to a markedly less degree than do unbruised fruit. Typical fruit grading devices that utilize this principle, however, make only a single measurement of the intensity of light reflected from the surface of the fruit. The devices do not detect abrupt variations in the reflectivity of the fruit surface, such as those commonly exhibited by surface blemishes in fruit, especially citrus fruit. Additionally, successful performance of such prior devices requires maintenance of a constant level of illumination, a requirement that is difficult to achieve in the environment in which such devices are typically used.

The sorting of fruit according to size has usually been performed in the past either by manual inspection or by a separate automatic sizing apparatus. This has necessitated multiple inspections of each fruit, thus aggravating the inefficiencies and performance drawbacks of such prior fruit sorting systems.

It will be appreciated from the foregoing that there is a definite need for a more reliable and more efficient technique for grading and sorting fruit according to size, blemish and color. In particular such a technique should utilize apparatus that performs merely one inspection of substantially the entire surface of each fruit, and should have sufficient resolution to detect even minute blemishes or flaws in the fruit surface and to allow grading into a relatively large number of categories. The present invention fulfills this need.

SUMMARY OF THE INVENTION

The present invention is embodied in a method and apparatus for grading and sorting articles, especially fruit, according to size, surface color and surface blemish. In accordance with the invention, the apparatus includes camera means for sensing light reflected from the surface of each fruit and generating a plurality of corresponding light measurement signals, which are transmitted to blemish detection circuitry for detecting significant variations between them to obtain a measure of the degree of blemish on the surface of each fruit. Additionally the light measurement signals are substantially concurrently transmitted to color detection circuitry for obtaining a color measurement for each of several distinct areas on the surface of each fruit.

More particularly, the subject apparatus includes a conveyor for continuously moving fruit one by one through an examining region where each fruit is examined sequentially by the camera means. The camera means includes a number of scanning or segmental cameras for generating light measurement signals that are transmitted to and processed by the blemish detection circuitry, and in addition, includes a number of separate color-sensitive cameras for generating other light measurement signals that are transmitted to and processed by the color detection circuitry.

The segmental cameras are circumferentially arranged in a blemish examining plane through which the fruit to be examined and graded is passed. Similarly, the color-sensitive cameras are circumferentially arranged in a a color examining plane through which the fruit is passed. The fruit is uniformly illuminated as it is dropped through the blemish examining and color examining planes, to provide light input to the segmental and color-sensitive cameras.

In the preferred embodiment of the invention, each segmental camera includes a linear array of photodiodes, located in the blemish examining plane and substantially circumferential with respect to a central region of the plane through which the fruit is passed. When a fruit is passing through the plane, each photodiode will receive reflected light from a unique segment of the fruit surface, and will generate an electrical signal proportional to the intensity of the light received from that segment.

The electrical signals from all of the photodiodes are read in a cyclic sequence, with the signals from the photodiodes of each segmental camera being read only after those generated by the photodiodes of the previous segmental camera. Since the fruit will have moved an incremental distance through the blemish examining plane during the time taken to read the signals from all of the photodiodes in one full cycle, it will be apparent that repetition of the sequential reading cycle will provide scans of additional, approximately planar portions of the fruit surface. In this manner, substantially the entire fruit surface can be examined by the photodiodes, in a helical scanning fashion.

The cyclic sequence of electrical signals derived from the photodiodes is designated a sequential scan signal, and, in accordance with one aspect of the invention, each successive value in this signal is compared, for example by division, with the values for neighboring segments, and a sequential correlation signal is generated in accordance with the comparisons made. This sequential correlation signal represents a measure of irregularities in the reflectivity of the fruit surface, such irregularities being due primarily to surface blemishes.

The correlation signal is then filtered to substantially eliminate all slowly varying signal components not attributable to surface blemishes, such as those caused by the curvature of the fruit. The filtered correlation signal is then further processed in an absolute value detector so that both positive and negative variations in surface reflectivity are taken into account. Finally, an integrator to which the resultant signal is fed provides a measure of the total surface blemish of the fruit.

A measure of the size of each fruit is obtained by counting the number of segments detected in the surface of the fruit as it passes the blemish examining plane. By dividing the measure of total surface blemish on the fruit by this measure of size, a normalized measure of the degree of surface blemish can be obtained.

In order to detect fruit color, each color-sensitive camera in the apparatus of the invention includes a red phototransducer and an infrared phototransducer. Reflected light received by each of the cameras in the color examining plane is first directed at a beam splitter. One portion of light from the beam splitter is passed through a red light filter before reaching the red phototransducer, and an equal portion is passed through an infrared light filter before reaching the infrared phototransducer. In this manner, each phototransducer in the pair receives light from the same portion of the fruit as it passes through the color examining plane.

More specifically, each color phototransducer generates an output signal indicative of the intensity of light incident on it. In accordance with one aspect of the invention, the output signals from each phototransducer pair are read in a sequential fashion and the measure of red light intensity is compared, for example by division, to the measure of infrared light intensity for each pair. Since the magnitude of reflected infrared light does not vary substantially with fruit ripeness or color, while the magnitude of reflected red light does so vary, the comparison (e.g. ratio) of the two signals is an effective measure of the color of a fruit.

During the time taken to measure the output signals from each phototransducer pair, and to compute the ratios of such signals, the fruit being examined will have moved an incremental distance through the color examining plane. The phototransducers, then, will provide output signals corresponding to the reflected light intensities for different portions of the fruit. Repeating the sequential phototransducer reading and ratio computation as the fruit moves completely through the examining plane provides color information for substantially the entire fruit surface.

The separately obtained color ratios for each fruit are then numerically averaged, to derive a measure of the average color of the fruit surface. Additionally, the separate color ratios are compared to a predetermined threshold and color count pulses are produced whenever the threshold is exceeded, or alternately, not exceeded. By counting the number of color count pulses for each fruit, measures of the amount of surface having a prescribed color are produced.

The measurements of normalized surface blemish, surface size and surface color, all obtained from the apparatus of the invention, are utilized to assign each fruit to a particular category or grade. The means employed to so assign the fruit can take any of a wide variety of specific forms, but can most conveniently take the form of a hard-wired or programmable computer.

Control signals provided by such a computer are utilized to actuate appropriate solenoids, and thereby discharge the fruit to particular receivers in accordance with the grade determinations. An example of apparatus for accomplishing this sorting process can be found in U.S. Pat. Nos. 3,768,645 to T. D. Conway et al, entitled "Method and Means for Automatically Detecting and Sorting Produce According to Internal Damage," and 3,930,994, also issued to T. D. Conway et al, and entitled "Method and Means for Internal Inspection and Sorting of Produce".

It will be apparent from the foregoing summary that the present invention represents a significant advance in apparatus and methods for grading fruit. In particular, the apparatus of the present invention grades fruit according to surface blemish, surface color, and size, and does so simultaneously by scanning substantially the entire surface of the fruit. Many other advantages and features of the present invention will become apparent from the following more detailed description of a preferred embodiment, taken in conjunction with the accompanying drawings, which disclose, by way of example, the principles of the invention.

BRIEF DESCRIPTION OF THE DRAWINGS

FIG. 3*a* is a simplified sectional view of a segmental camera and a color-sensitive camera, taken substantially along the line 3*a*—3*a* in FIG. 2;

FIG. 3*b* is a simplified perspective and schematic view of a segmental and color-sensitive camera pair, showing the paths of light reflected from a fruit in the examining region to the respective cameras;

FIG. 8 is a diagrammatical representation of the composite views seen by the four segmental cameras as a fruit drops through their fields of view;

FIG. 9 is a more detailed view of a portion of the composite view of one segmental camera in FIG. 8;

FIG. 10 is a diagrammatical view of a portion of the camera scan signal for one segmental camera, superimposed on a blemished portion of a fruit surface to which it corresponds;

DESCRIPTION OF THE PREFERRED EMBODIMENT

1. Overview

Figure 1:
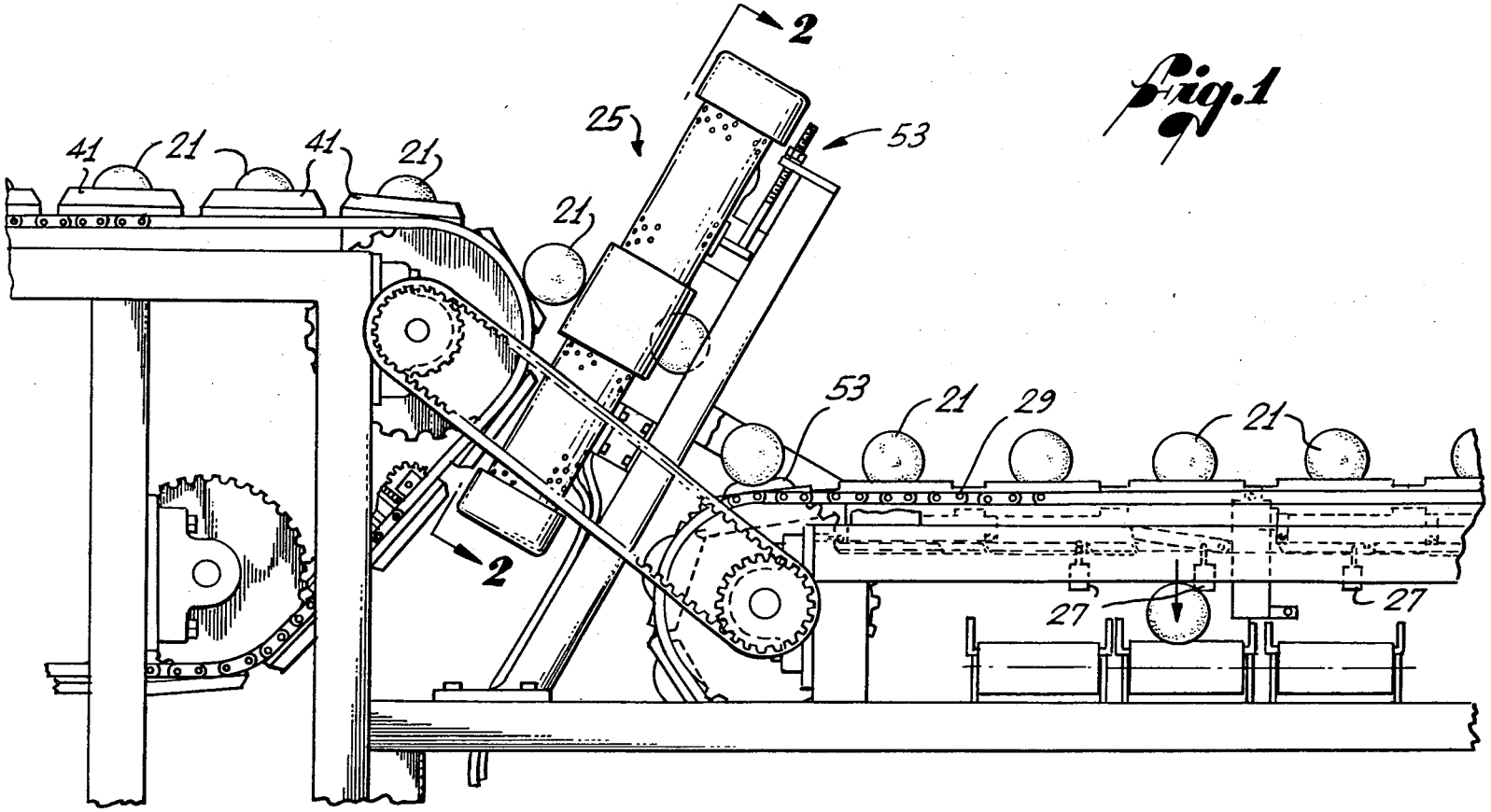
FIG. 1 is a side elevational view of a fruit transport structure in which the apparatus of the present invention is employed, showing in particular the fruit conveyors, the camera array and the sorting station.

As shown in the exemplary drawings, the present invention is embodied in an improved apparatus for grading and sorting fruit according to size, surface color and surface blemish. It will be understood that, while the invention is particularly well suited for detecting surface blemishes, surface color and size of fresh fruit, it could be used just as effectively for the detection of irregularities in surface reflectivity, color and size of other like articles.

In accordance with the present invention, fruit 21 are received on a first conveyor 23 and are passed one by one through a camera array 25 that includes segmental cameras 31 used in detecting the degree, if any, to which the surface of each fruit is blemished, and color-sensitive cameras 33 used in determining the average color of each fruit.

Figure 3C:
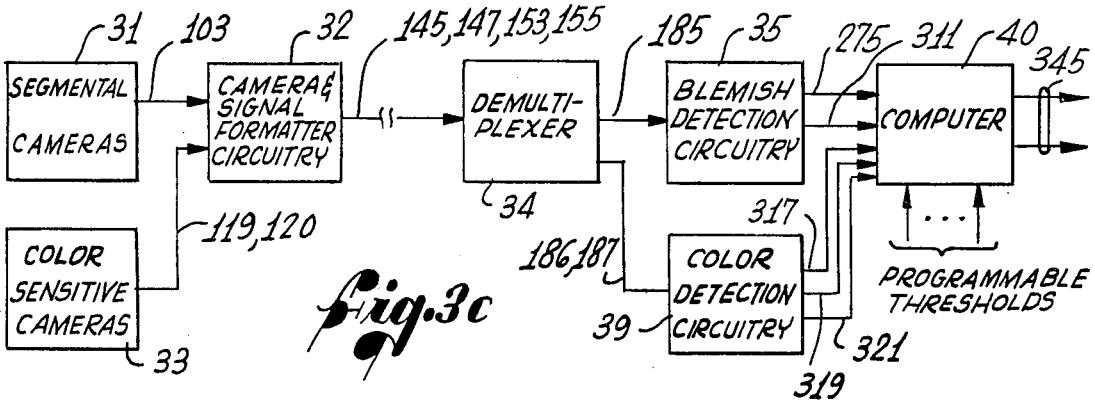
FIG. 3*c* is a simplified block diagram of the circuitry of a fruit grading apparatus constructed in accordance with the present invention.

The segmental cameras 31 measure the intensity of light reflected from each of a plurality of segments of the surface of each fruit 21, and the color-sensitive cameras 33 measure the intensities of both red and infrared light reflected from a plurality of narrow strips on the fruit surface. As shown generally in FIG. 3*c*, signals from the segmental cameras 31 and the color-sensitive cameras 33 are suitably multiplexed together in camera and signal formatter circuitry 32, which, in turn, transmits the multiplexed signals to a demultiplexer 34. The demultiplexer 34, which may be conveniently located in a remote control room, separates the data signals and transmits them to blemish detection circuitry 35 and color detection circuitry 39, for further processing.

The blemish detection circuitry 35 receives measurement signals generated in the segmental cameras 31 and compares the signal for each segment to corresponding signals for neighboring segments, to obtain a comparison or quotient sequence signal indicative of the degree of irregularity in reflectivity of the surface of the fruit. The blemish detection circuitry 35 also filters and integrates the quotient sequence signal, to obtain a measure of the total surface blemish for each fruit. Simultaneously, a size detection circuit 37 (FIG. 7), integral with the blemish detection circuitry 35, counts the number of segments in the total reflective surface of each fruit, to obtain a measure of the size of the fruit.

The color detection circuitry 39 receives signals derived from the color-sensitive cameras 33, and sums together ratios of red light intensity to infrared light intensity for each of the narrow strips on the surface of each fruit. A count of the number of narrow strips on the the surface of each fruit is simultaneously generated.

The successive measures of surface blemish and fruit size from the blemish detection circuitry 35, and the successive color ratio summations and counts of surface strips from the color detection circuitry 39, are transmitted to a computer 40, which generates normalized measures of surface blemish by dividing the successive measures of total surface blemish by the corresponding measures of fruit size. Simultaneously the computer 40 determines the average color of each fruit by dividing the successive color ratio summations by the corresponding counts of surface strips.

In accordance with the successive normalized measures of surface blemish and average color determinations, the computer 40 provides control signals to appropriate solenoids 27 at a sorting station 28, to divert the fruit to appropriate locations.

2. Fruit Transport Structure

FIG. 1 shows the fruit transport structure that conveys the fruit 21 past the camera array 25 to the sorting station 28, where it is diverted to specified locations by the solenoids 27. Fruit 21 is delivered on the first conveyer 23, with each fruit in a separate tray 41, to the camera array 25, through which it is dropped in a sequential fashion. Thereafter, the fruit is received by a second conveyor 29, which comprises a series of deformable cushions 43, such as bean bags, that move synchronously with the trays 41 of the first conveyor 23. The second conveyor used herein is described in U.S. Pat. No. 3,961,701 to P. F. Paddock et al, entitled "Method of and Conveyor for Transporting Fragile Objects". Each fruit that drops through the camera array 25 is caught and retained by a single cushion 43, which then transports the fruit to the sorting station 28.

3. Camera Array

Figure 2:
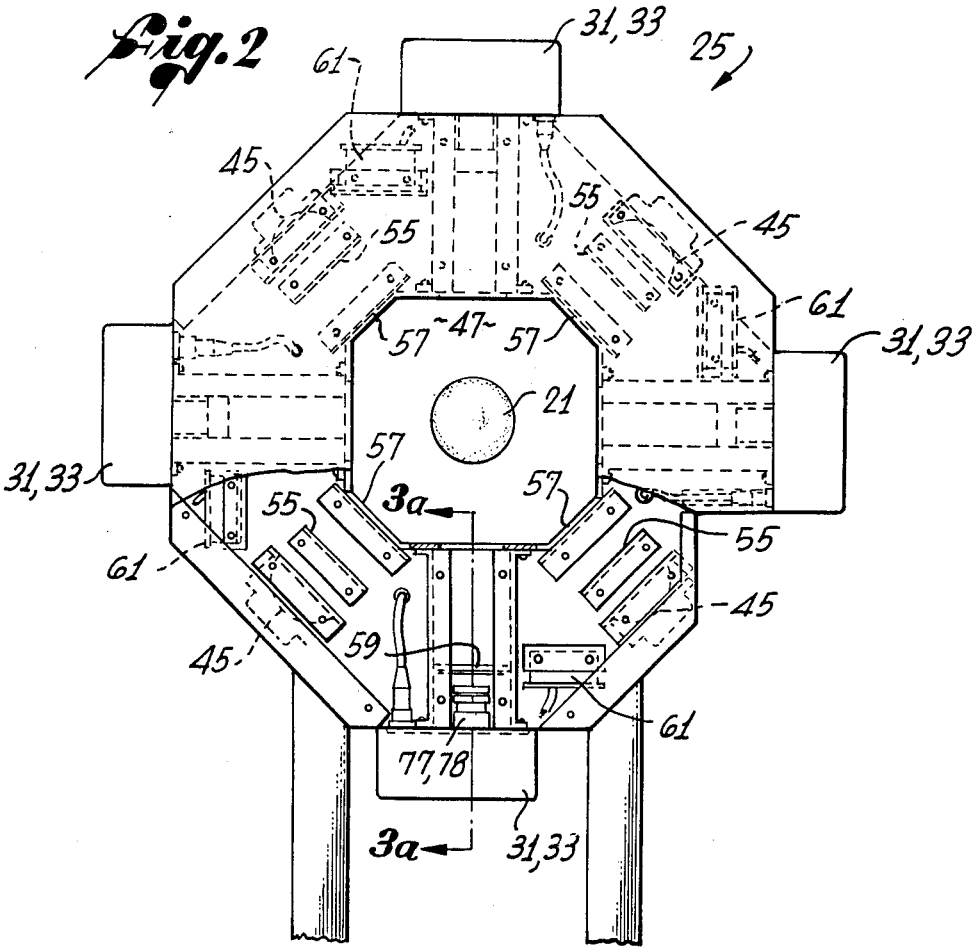
FIG. 2 is a plan view of the camera array, taken substantially along the line 2—2 in FIG. 1.

As shown in FIG. 2, the camera array 25 houses the segmental cameras 31 and the color-sensitive cameras 33, which examine the fruit 21 simultaneously as it passes through the array's field of view. Additionally, the camera array houses illuminators 45 for directing light at the fruit as it is being examined.

More particularly, the camera array 25 comprises a donut-shaped carriage in which are housed four segmental cameras 31, four color-sensitive cameras 33 and four broad-band illuminators 45. The illuminators are spaced about 90° apart, in a substantially planar arrangement, directing light at a centrally located examining region 47, through which the fruit is dropped. Substantially the entire surface of the fruit is illuminated as it drops through the region. The background area of the examining region 47 is black and substantially non-reflective, so that the presence of a fruit can be more readily detected.

The four segmental cameras 31 are spaced circumferentially around the fruit examining region 47. The fields of view of the cameras 31 form a blemish examining plane 49 (FIG. 3*a*) that is within the fruit examining region 47 and substantially perpendicular to the direction of travel of the fruit through it. The segmental cameras 31 are also spaced about 90° apart, with each camera staggered midway between two adjacent illuminators 45. The field of view of each segmental camera is sufficient to permit a full examination of the largest fruit that is to be graded.

Similarly, the four color-sensitive cameras 33 are also spaced circumferentially around the fruit examining region 47, forming a color examining plane 51 (FIG. 3*a*) that is also within the region 47 and substantially perpendicular to the direction of travel of the fruit through it. The color examining plane 51 is substantially parallel to the blemish examining plane 49, and preferably closely spaced thereto. The color cameras 33 are located at the same angular positions as the segmental cameras 31, in a staggered relationship with the illuminators 45, and the field of view of each color camera is sufficient to permit a full examination of the largest fruit that is to be graded.

The camera array 25 is equipped with adjustable mounting means 53, as depicted in FIG. 1, whereby the position of the array relative to the conveyors 23 and 29 can be adjusted to center the falling fruit 21 in the middle of the blemish examining plane 49 and the color examining plane 51, where they can be most effectively viewed by all of the segmental and color-sensitive cameras 31 and 33.

As shown in FIGS. 2 and 3*b*, a heat absorbing filter 55 is located in front of each illuminator 45. This reduces the intensity of light having wavelengths beyond the near-infrared band, thereby reducing temperature buildup in the fruit examining region 47.

Also located in front of the illuminators 45 is a first set of polarizers 57 for allowing transmission of light having only one polarity. Located in front of the segmental cameras 31 and the color cameras 33 is a second set of polarizers 59 for allowing transmission of only light having the opposite polarity. In this manner, all direct reflections, i.e. "glare," from the fruit being examined are eliminated from the fields of view of the cameras, and a more authentic indication of the color and reflectivity of the fruit can be obtained.

Cooling fans 61 are located adjacent to each of the illuminators 45, to dissipate heat generated in the camera array structure, particularly in the heat absorbing filters 55 and the first set of polarizers 57. In the illustrated embodiment of the invention, each of the fans 61 is located between an illuminator 45 and a pair of the cameras 31 and 33, and is oriented to blow cooling air across the filter 55 and polarizer 57.

3.1 Segmental Camera

As shown in FIGS. 3*a* and 3*b*, each segmental camera 31 includes a linear-photodiode array 63, such as Model No. RLC-64P manufactured by Reticon Corporation of Sunnyvale, California. The photodiode array 63 is sensitive over a broad range of light wavelengths, and is oriented with its axis substantially perpendicular to the direction of travel of the fruit, i.e., with each element of the array positioned to receive light from a different segment of the fruit surface. It will be apparent from FIGS. 3*a* and 3*b* that each segmental camera 31 is housed with a corresponding color-sensitive camera 33, and that the pair of cameras is protected from dust particle contamination by a cover plate 73. Light is received from the examining region 47 through a segmental camera aperture 75 located in the cover plate 73, and is focused by a segmental camera lens 77 on the photodiode array 63. Thus the field of view of each photodiode array is a narrow swath of the examining region, substantially perpendicular to the direction of travel of the fruit.

3.2 Color-Sensitive Camera

Each color-sensitive camera 33 includes a red phototransducer 65 and an infrared phototransducer 67. Each of the red and infrared phototransducers is a conventional diffused silicon photodiode, such as a PIN-6DP manufactured by United Detector Technology, Inc. of Santa Monica, Calif. As shown in FIGS. 3*a* and 3*b*, the red phototransducer 65 receives light through a red light filter 69, and thereby measures the intensity of red light received by the camera, and the infrared phototransducer 67 receives light through an infrared light filter 71, and thereby measures the intensity of infrared light received by the camera.

Since the measure of surface color of the fruit being examined is obtained by computing the ratio of red light intensity to infrared light intensity, it is preferable that the red and infrared phototransducers 65 and 67 in each color-sensitive camera 35 have a common field of view and thus receive light from generally the same source. Preferably, this is accomplished using a single color camera lens 78 and a beam splitter 79, preferably of a conventional cube type.

Light is received from the examining region 47 through a color camera aperture 76 located in the cover plate 73, and is focused by the lens 78 through the beam splitter 79 and the respective red and infrared filters 69 and 71, and onto the respective red and infrared phototransducers 65 and 67. Additionally, a red phototransducer aperture 81 and an infrared phototransducer aperture 82, oriented substantially perpendicular to the direction of the fruit's travel, are located in front of the respective red and infrared phototransducers 65 and 67. Each aperture restricts the light incident on such phototransducers to that received from a narrow swath of the examining region 47. Thus, when a fruit is in the examining region, the two phototransducers in each color-sensitive camera receive light of different wavelengths from an identical narrow strip on the fruit surface.

4. Camera and Signal Formatter Circuitry

The camera and signal formatter circuitry 32 (FIG. 5) of the present invention sequentially reads voltage signals generated by the photodiode arrays 63 of the segmental cameras 31, and by the red and infrared phototransducers 65 and 67 of the color-sensitive cameras 33. The circuitry 32 interleaves the successive readings into a serial data stream and converts each reading from analog form into a serial 8-bit digital word. The successive serial words, in turn, are transmitted to a remote control room where the words are demultiplexed by the demultiplexer 34, and fed to the blemish and color detection circuitry 35 and 38, and thence to the computer 40, which analyzes the data to determine the proper grade category for each fruit.

More particularly, the voltage signals generated in the photodiodes of the photodiode array 63 of each segmental camera 31 are read out serially and transmitted to a diode array multiplexer 85. This multiplexer 85, in turn, interleaves (or multiplexes) these signals with those from the other segmental cameras, to form a composite photodiode scan signal. After all the separate photodiode signals have been read out and interleaved with each other, the process is repeated, cyclicly.

The voltage signals generated in the red and infrared phototransducers 65 and 67 of each color-sensitive camera 33 are similarly multiplexed in a color camera multiplexer 87. This multiplexer 87 separately interleaves the respective red signals together to form a composite red signal, and the respective infrared signals together to form a composite infrared signal. After all of the signals have been interleaved in this manner, the process is repeated cyclicly. Successive values of the composite red signals are divided by the corresponding infrared signals in an analog divider 89, to form a succession of color ratios.

The composite photodiode scan signal from the diode array multiplexer 85, along with the composite infrared signal from the color camera multiplexer 87 and the successive color ratios from the analog divider 89 are all input to a camera multiplexer 91, which interleaves these inputs into a single analog data signal.

This analog data signal is then fed to an analog-to-digital converter 93, which converts the successive analog readings into serial 8-bit binary words, and a line driver 97 then transmits the serial words to the remote control room. Control of the timing for the multiplexing operations performed by the camera and signal formatter circuitry is provided by a timing unit A 95, which will shortly be discussed in detail.

4.1 Segmental Camera Data

As already briefly described, the segmental cameras 31 generate analog voltage signals that are used to determine the degree of blemish on the surface of the successive fruit being examined. In the presently preferred embodiment of the invention, the photodiode array 63 of each segmental camera 31 comprises a linear arrangement of sixty-four contiguous light-sensitive diodes. The axis of the array is located in the blemish examining plane 49, substantially perpendicular to the direction of travel of the fruit, and substantially perpendicular to a radial line from the center of the first examining region 47. Each of the diodes generates a voltage signal directly proportional to the intensity of light incident on it, so that at any given instant, the diode array registers sixty-four separate measurements of light received from contiguous sectors of the blemish examining plane.

Since the four segmental cameras 31 are spaced circumferentially around the blemish examining plane 49, the photodiodes generate signals representative of light received from segments forming a 360° swath on the surface of a fruit passing through the plane. It will be appreciated that when the fruit does not completely fill the field of view of each segmental camera 31, some of the photodiodes (i.e., those near the ends of each array 63) will still be examining the black background area of the examining region 47, and will therefore generate a negligible output voltage.

Figure 5A:
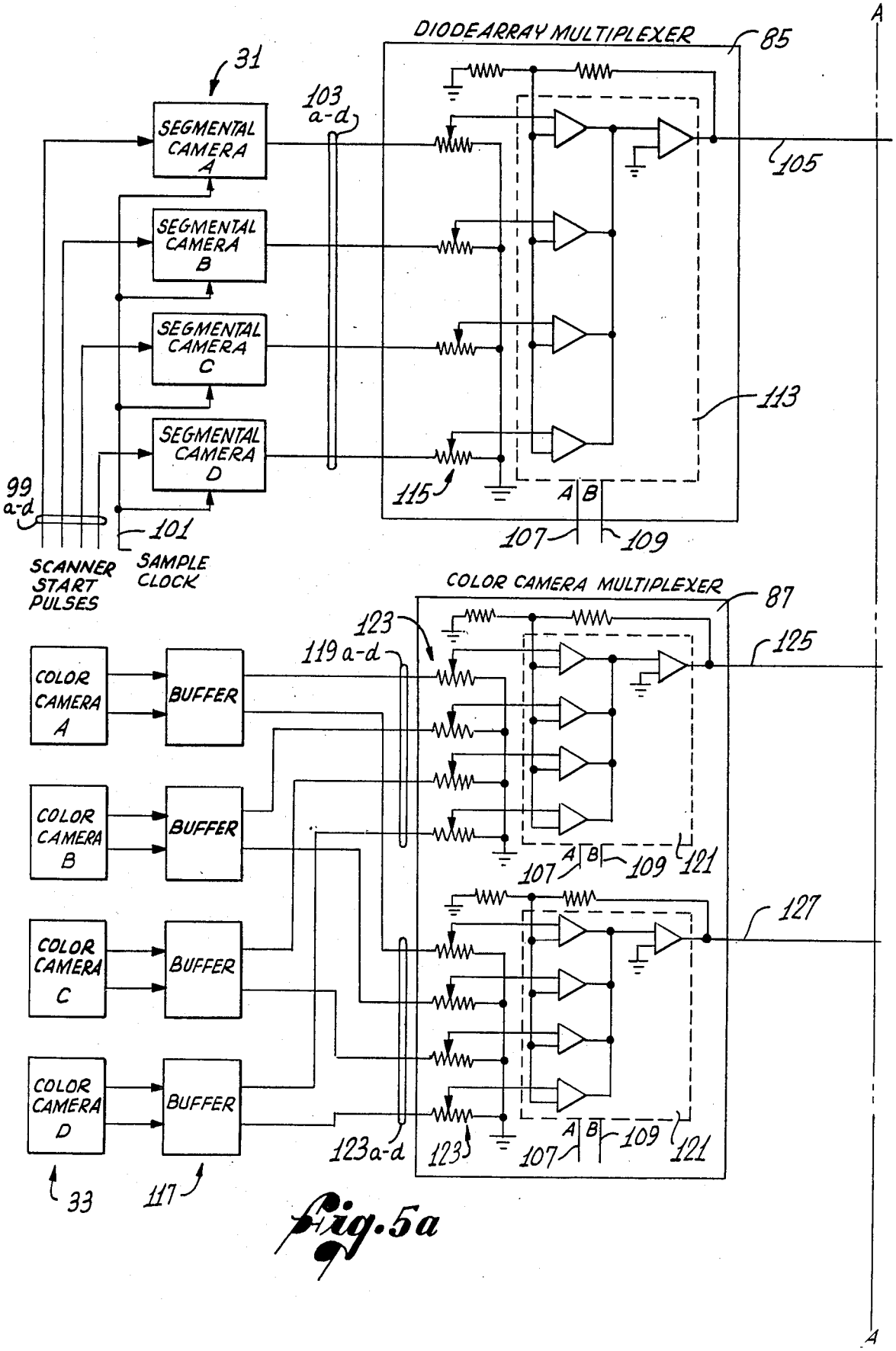
FIGS. 5*a* and 5*b* together form a more detailed block diagram of the camera and signal formatter circuitry of the apparatus of FIG. 4.
Figure 5B:
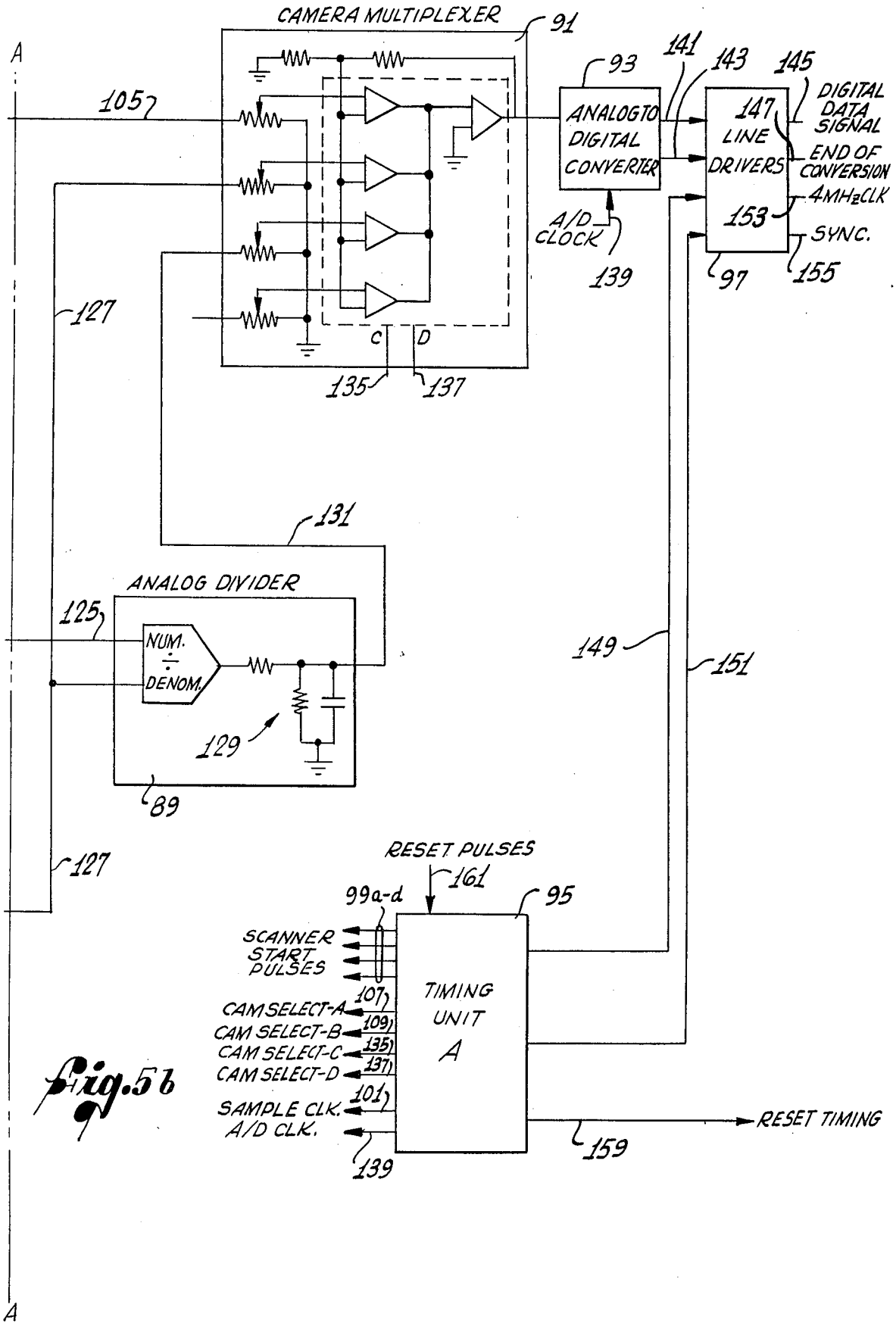

The timing unit A 95, as already mentioned, controls the timing of multiplexing operations performed by the camera and signal formatter circuitry of FIG. 5. More specifically, the timing unit A 95 provides unique scanner start pulses on lines 99*a*–99*d*, and a sample clock signal on line 101 to each of the four photodiode arrays 63 in the segmental cameras 31. The occurrence of a scanner start pulse enables the sample clock signal to clock out the sixty-four analog diode voltages, thereby forming a serial camera scan signal. The four photodiode arrays are read in a sequential fashion, with each array receiving its particular scanner start pulse only after all sixty-four diodes in the previously accessed array have been serially read out. The four camera scan signals are transmitted to the diode array multiplexer 85 over lines 103*a*–*103d*, respectively.

The diode array multiplexer 85, shown in FIG. 5, receives the four camera scan signals on lines 103*a*–103*d*, and time-division multiplexes them together, to generate a composite scan signal on line 105. Camera select signals A and B, received from the timing unit A 95 on lines 107 and 109, respectively, control a sequential selection of the camera scan signals from the four segmental cameras 31. The selection corresponds with the timing of the readouts of the respective photodiodes, so that an interleaving of the four camera scan signals supplied over lines 103*a* through 103*d* is achieved.

As shown in FIG. 5, the diode array multiplexer 85 includes a selectable input operational amplifier 113, such as No. HA2405, manufactured by Harris Semiconductor of Melbourne, Florida. Variable resistors 115 are provided at the four signal inputs of the amplifier so that manual compensation for any substantial phototransducer voltage offsets can be accomplished.

It will be appreciated that a portion of the composite scan signal, comprising one complete sequential selection from each of the four camera scan signals, is a representation of the light intensity received from a narrow 360° swath around a fruit in the examining region 47. During the time elapsed while each 360° scan portion of the composite scan signal is being generated, the fruit will have dropped an incremental distance through the examining region and the respective photodiodes will view different portions of the fruit surface. Repeating the selection process performed by the diode array multiplexer 85, then, results in further 360° swaths, whereby a helical-type scan of the fruit surface is achieved. The clock rate is selected so that successive 360° swaths are substantially contiguous to each other. Any changes in the velocity of the fruit as it moves through the examining region do not affect the relative spacing of successive swaths by a significant amount.

As used hereinafter, the expression "camera scan" relates to the sequential data included in one readout of the photodiode array 63 of one segmental camera 31. Further, the expression "360° scan" relates to the sequential data included in four successive camera scans, one by each of the segmental cameras.

FIG. 8 shows the composite views of each of the four segmental cameras 31 as a fruit drops from top to bottom through the blemish examining plane 49. The arrangement of substantially contiguous swaths in each view represents the sequence of scans performed by the photodiode array as the fruit drops through its field of view. It will be appreciated that, since the fruit is moving while each scan is occurring, the scan swaths are sloped to a slight degree.

FIG. 9 shows the images that a blemish 111 will provide when it is located approximately midway between the centers of the fields of view of adjacent segmental cameras 31. Because of the curvature of the fruit and because of the oblique angle at which the blemish is viewed, it appears to be smaller than its actual size. However, any error introduced by this viewing angle is substantially compensated for by the fact that the blemish is viewed and detected by two adjacent segmental cameras.

A surface blemish is typically characterized by reflection of light to a substantially different degree from that associated with reflection from the surrounding unblemished portion. It is this abrupt change in reflectance at the blemish edges that the preferred embodiment of the invention is particularly adapted to detect and measure.

FIG. 10 depicts in more detail portions of the camera scan signal from one segmental camera 31 over seven consecutive camera scans. The signal is superimposed on the outline of a blemished portion of the fruit to which it corresponds. The numbered column-like regions in the figure correspond to a sequence of photodiodes, and the signal waveforms labeled $S_1$–$S_7$ represent the voltage levels of the signals for the seven consecutive camera scans. It can be readily seen from FIG. 10 that the camera scan signal rises to relatively high voltage levels for unblemished segments of the fruit, and falls to relatively low levels for blemished segments and for the black background area of the examining region 47. Further, it is apparent that the signal voltage level tends to be lower for segments near the fruit edge, because of the oblique angle at which such segments are viewed.

The manner in which the segmental camera scan signals are further processed will be explained after a description of initial processing of the color-sensitive camera data.

4.2 Color-Sensitive Camera Data

The color-sensitive cameras 33 generate analog voltage signals that are employed to determine the surface color of the successive fruit being examined. Each color-sensitive camera 33 views a narrow strip of the surface of a fruit in the examining region 47, the strip being substantially perpendicular to the direction of travel of the fruit. The strip is defined by the respective red and infrared phototransducer apertures 81 and 82, and the light received from this strip is focused through the respective red and infrared filters 69 and 71 and onto the corresponding red phototransducer 65 or infrared phototransducer 67, as shown diagrammatically in FIG. 3A. The phototransducers then generate signals at voltages proportional to the intensities of the light they receive.

As shown in FIG. 5, the voltage outputs of the various red and infrared phototransducers 65 and 67 are suitably buffered in buffers 117; then the "red" signals are transmitted over lines**119*a*—119*a*, and the "infrared" signals transmitted over lines 120*a*–120*d*, all to the color camera multiplexer 87. The camera select signals A and B, received on lines 107 and 109, are used to select sequentially from the various buffered phototransducer outputs, whereby a composite red signal and a composite infrared signal are generated. In a fashion similar to the generation of the composite scan signal by the diode array multiplexer 85, the sequential reading of the phototransducer voltages, coupled with the movement of the fruit through the examining region 47**, results in a helical-type scan of the fruit surface.

The color camera multiplexer 87 includes two selectable input operational amplifiers 121, one for generating the composite red signal and the other for generating the composite infrared signal. Variable resistors 123 are provided at the inputs of the amplifiers so that munual compensation for any substantial phototransducer voltage offsets can be accomplished.

The composite red and infrared signals are output from the operational amplifiers 121 on lines 125 and 127, respectively, and transmitted to the analog divider circuit 89, which generates, in real time, the ratio of the magnitude of the red signal to that of the infrared signal. The analog divider 89 can be, for example, Part No. BB4291, manufactured by Burr-Brown Research Corporation of Tucson, Ariz. The divider 89 includes an integral low-pass filter 129 on its output stage, for eliminating spurious voltages that might occur at the transitions between successive red and infrared readings. It will be appreciated that the color ratio signal generated by the divider comprises a sequential representation of the ratio of red light intensity to infrared light intensity for a succession of fruit surface portions forming a helix on the surface of the fruit.

The color ratios generated in the aforedescribed manner are substantially insensitive to variations in illumination intensity and to variations in the proportion of the fields of view of the color cameras 33 that is occupied by the fruit. Any such variations would result in corresponding variations in both the red and infrared phototransducer measurements, and thus would be substantially self-cancelling in the ratio computations.

4.3 Composite Camera Data

The composite segmental camera scan signal on line 105, the composite infrared signal on line 127, and the color ratio signal on line 131 are all transmitted to the camera multiplexer 91, which interleaves the three signals to form a combined analog data signal on line 133. Data select signals C and D, supplied over lines 135 and 137 from the timing unit A 95, control the interleaving by deleting the first and last photodiode readings in the sequence of sixty-four readings in each camera scan of the composite segmental camera signal, and inserting in their respective places the color ratio signal derived from the corresponding color-sensitive camera 33, and the infrared color signal derived from the color-sensitive camera 33 next in sequence.

Thus, the analog data signal on line 133 comprises, in sequence, the infrared color signal and color ratio signal derived from one color-sensitive camera 33, followed by 62 readings derived from the corresponding segmental camera 31. This is followed, in turn, by the same sequence of signals derived from the next associated pair of cameras.

As will be explained in more detail, the successive readings of the segmental cameras 31 are used by the blemish detection circuitry 35 (FIG. 3B), to obtain a measure of blemish on the surface of each fruit. The infrared color signal and the color ratio signal will both be used by the color detection circuitry 39 (FIG. 3B). The infrared color signal will be used to determine whether or not a portion of a fruit surface is being examined, and the color ratio signal will be used to obtain a measure of the color of that fruit surface portion.

The deletion of two photodiode readings from each sequence of sixty-four does not significantly affect the blemish detection capability of the invention apparatus, because the remaining sixty-two readings can adequately cover a fruit in the blemish examining plane 49. Moreover, the signals derived from the first and last photodiodes on present commercially available photodiode arrays are generally less reliable than those derived from the other photodiodes.

The analog data signal on line 133 is transmitted to the analog-to-digital converter 93, for conversion to a corresponding digital data signal. The converter 93 can be, for example, an ADC 82, manufactured by Burr-Brown, and it provides a serial output comprising a sequence of 8-bit words. In addition, an end-of-conversion pulse is generated at the end of each such 8-bit segment. An A/D clock signal on line 139 from the timing unit A 95 controls the conversion performed by the analog-to-digital converter 93. The clock signal comprises sequential bursts of eight clock pulses, one such burst occurring for each independent reading in the analog data signal. The analog-to-digital conversion is performed primarily to facilitate transmission of the data more easily over a lengthy cable to a remote control room, where the remaining equipment of the system can be better protected from the environment of the fruit transport structure.

The digital data signal and the end-of-conversion signal are transmitted over lines 141 and 143, respectively, to the differential line driver circuit 97, which, in turn, transmits the two signals on cables 145 and 147, respectively. Additionally, the timing unit A 95 transmits a clock signal and a scan sync signal on lines 149 and 151, respectively, to the differential line driver circuit 97, which, in turn, transmits these two signals on cables 153 and 155, respectively. The cables 145, 147, 153 and 155 are routed to the remote control room where the demultiplexer 34 and the blemish and color detection circuitry 35 and 39, respectively, are located.

Also routed to the remote control room is a reset timing signal on line 159 generated by the timing unit A 95, in response to receipt of periodic reset pulses on line 161 from a sensor (not shown) adjacent to the first conveyor 23. The sensor generates a pulse on detection of a conveyor tray 41 on which a fruit is carried. The timing unit A 95 includes adjustable delay means for allowing manual adjustment of a time delay between the receipt of each reset pulse on line 161 and the generation of a pulse in the reset timing signal on line 159.

This completes the description of the generation, multiplexing and formatting of signals derived from the cameras 31 and 33. Accordingly, the following descriptive sections deal with demultiplexing and utilization of the signals.

5. Demultiplexer

The demultiplexer 34 (FIG. 3B) separates the successive serial 8-bit binary words received from the camera and signal formatter circuitry 32 into separate sequences of blemish words, color ratio words and infrared words. Each blemish word corresponds to a reading of one photodiode in the photodiode array 63 of one segmental camera 31. Each infrared word corresponds to a reading of the infrared phototransducer 67 of one color-sensitive camera 33, and similarly, each color ratio word corresponds to a ratio of readings of the red and infrared phototransducers 65 and 67 from one color-sensitive camera 33. The blemish words, color ratio words, and infrared words are subsequently processed in the blemish detection circuitry 35 and color detection circuitry 39.

Figure 4:
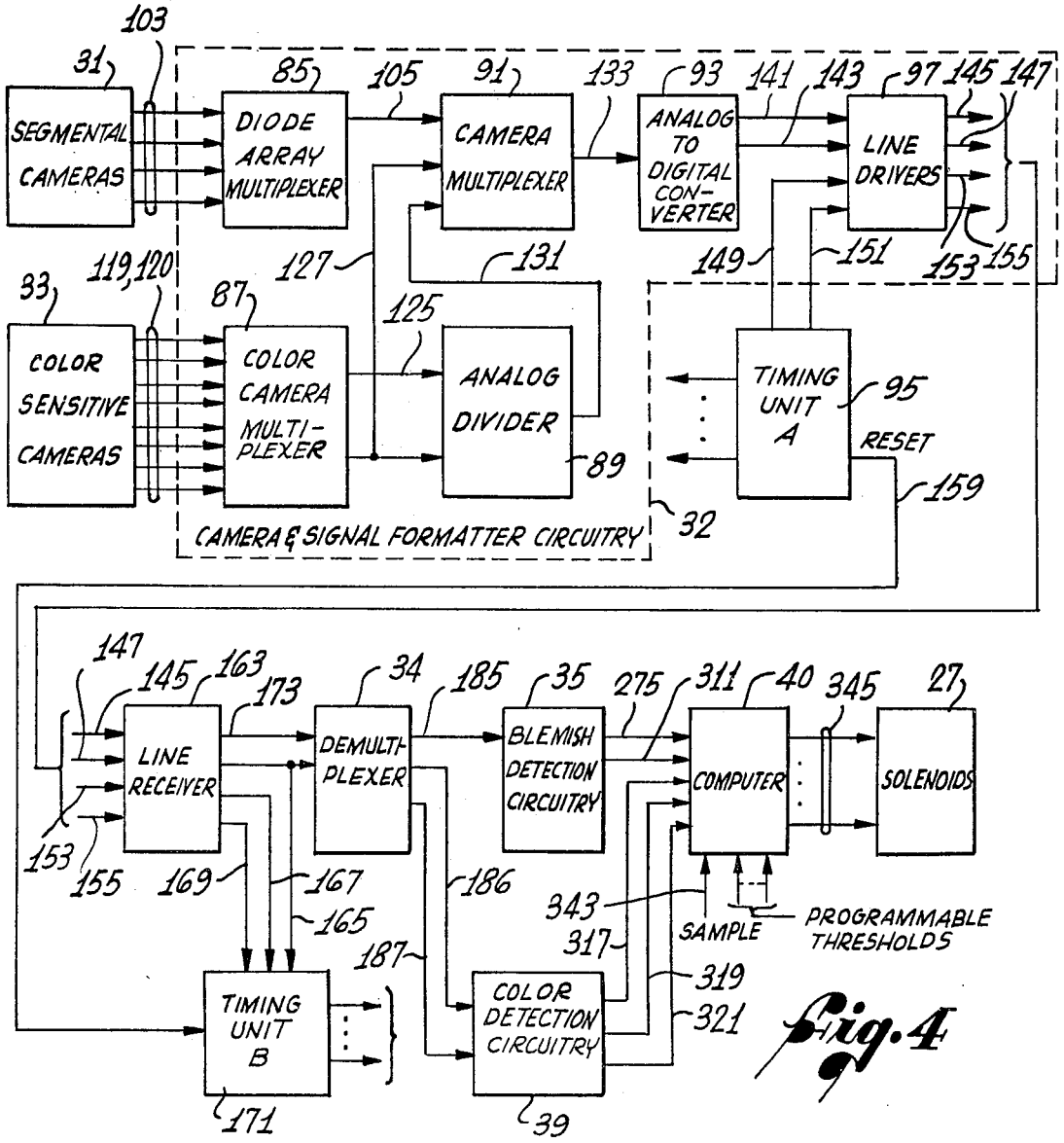
FIG. 4 is a more detailed block diagram of the fruit grading apparatus of FIG. 3*c*.

As shown in more detail in FIG. 4, the digital data signal on cable 145, the end-of-conversion signal on cable 147, the clock signal on cable 153 and the scan sync signal on cable 155 are received by a conventional differential line receiver circuit 163, which reconverts the signals to "single-ended" logic. The differential line receiver circuit 163 comprises four separate line receivers, such as Part No. SN 75115, manufactured by Texas Instruments, Inc. of Dallas, Texas, along with appropriate resistor terminators to match the characteristic impedance of the cables.

A timing unit B 171 receives the end-of-conversion signal, the bit clock signal and the scan sync signal over lines 165, 167 and 169, respectively, from the line receiver circuit 163. The timing unit B 171 also receives the reset signal directly over line 159 from timing unit A 95, and generates all the timing signals required by the demultiplexer 157, the blemish detection circuitry 35 and the color detection circuitry 39.

Figure 6:
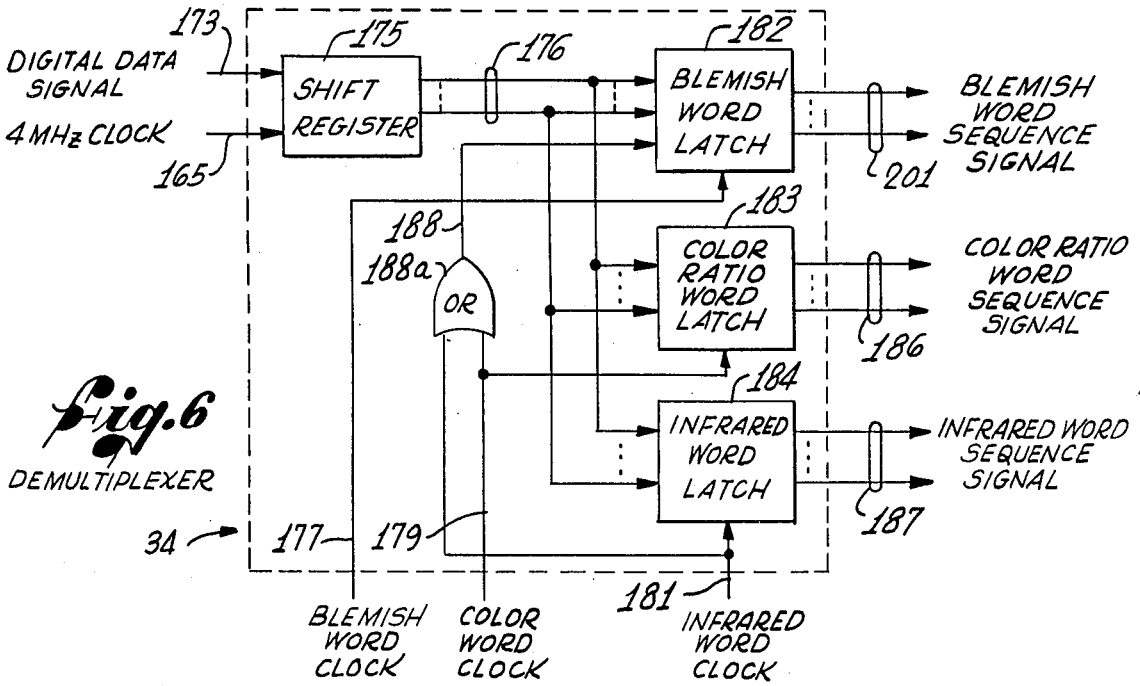
FIG. 6 is a more detailed block diagram of the demultiplexer of the apparatus of FIG. 4.

The digital data signal and the bit clock signal are transmitted over lines 173 and 165 from the line receiver circuit 163 to the demultiplexer 34. The demultiplexer 34, as shown in more detail in FIG. 6, converts the digital data from a serial format to a parallel format, and demultiplexes the various digitized components of the composite signal, i.e., the sequential measurements of the composite scan signal, the readings of the composite infrared color signal, and the computed ratios of the color ratio signal. Serial-to-parallel conversion is performed by a conventional 8-bit shift register 175 into which the digital data signal is clocked by the clock signal on line 165. The eight bits stored in the shift register 175 at any given time, are registered on lines 176 from its eight output terminals.

A blemish word clock signal, a color word clock signal, and an infrared word clock signal, all supplied from the timing unit B 171 on lines 177, 179 and 181, respectively, control the demultiplexing function of the demultiplexer 34. The color word clock signal on line 179 is utilized to clock the eight-bit output from the shift register 175 into a color ratio word latch 183, and comprises a sequence of pulses, each occurring in the first blemish word period in each camera scan, when the 8-bit word corresponds to a color ratio word. Similarly, the infrared word clock signal is utilized to clock the eight-bit output from the shift register 175 into an infrared word latch 184, and also comprises a sequence of pulses, each occurring in the sixty-fourth blemish word period in each camera scan, when the 8-bit word corresponds to an infrared word.

The blemish word clock signal is utilized to clock the eight-bit output from the shift register 175 into a blemish word latch 182, and comprises a sequence of pulses, each occurring whenever the eight bits then stored in the shift register corresponds to either a blemish word, a color ratio word, or an infrared word. Color ratio and infrared words are inhibited from being clocked into the blemish word latch, however, by an inhibit signal supplied on line 188 from an OR gate **188*a*, which OR's together the color word clock signal and the infrared word clock signal, received on lines 179 and 181**, respectively.

At the end of each word time, the word is clocked into either the blemish word latch 182, the color ratio word latch 183 or the infrared word latch 184, as appropriate. The blemish word latch 182 outputs a blemish word sequence signal on lines 185, the color ratio latch 183 outputs a color ratio word sequence on lines 186, and the infrared latch 184 outputs an infrared word sequence signal on lines 187.

6. Blemish Detection Circuitry

Figure 7:
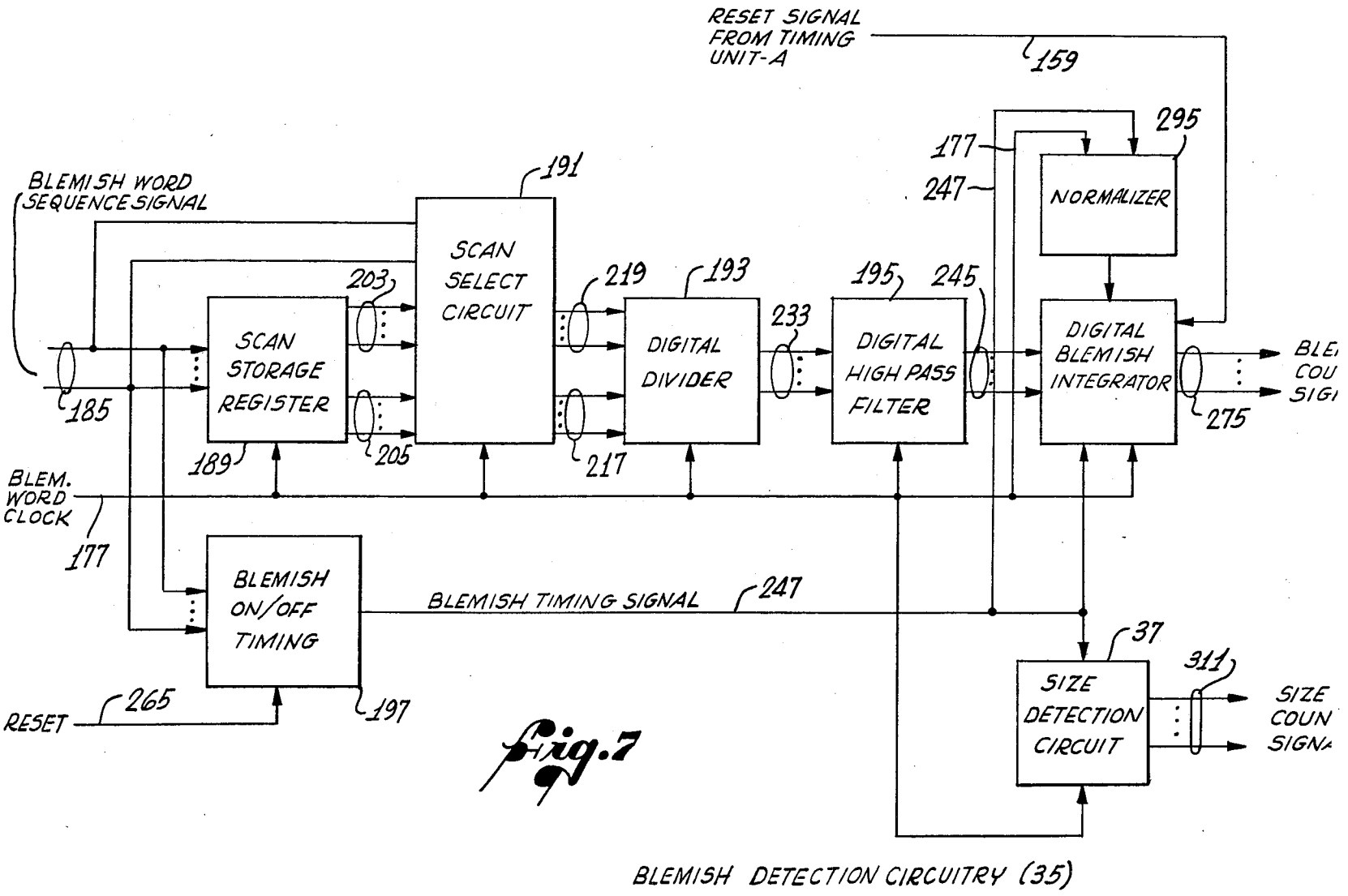
FIG. 7 is a more detailed block diagram of the blemish detection circuitry of the apparatus of FIG. 4.

The blemish detection circuitry 35, shown in detail in FIG. 7, receives the successive demultiplexed blemish words on lines 185 from the demultiplexer 34, and analyzes the words to determine the total amount of blemish on the surfaces of the successive fruit being examined. For each segment of a fruit being examined, its corresponding blemish word is compared to blemish words for neighboring segments, to obtain a measure of change in reflectivity for that portion of the fruit surface. In the presently preferred embodiment of the invention, the comparison is made by dividing each blemish word by the average of either the two immediately preceding blemish words or the two immediately subsequent blemish words for the corresponding photodiode.

The successive blemish word comparisons are performed by a scan storage register 189, which stores blemish words corresponding to the two immediately preceding 360° scans, a scan select circuit 191, which formats the data into successive numerators and denominators, and a digital divider 193, which performs the actual division. The successive blemish word quotients, generated by the digital divider 193, are filtered in a digital high-pass filter 195 to remove any slowly varying elements that might be present, such as those introduced by the curvature of the fruit.

A digital blemish integrator 199 then integrates the successive filtered words derived by the digital high-pass filter 195, to obtain a measure of total surface blemish for each fruit. A blemish on/off timing circuit 197 controls the integrator 199 so that only words corresponding to actual segments of the fruit surface, as contrasted with the black background of the examining region 47, are integrated.

6.1 Scan Storage Register

The scan storage register 189 comprises a pair of 8×256 bit shift registers for storing the parallel 8-bit blemish words for two successive 360° scans by the four segmental cameras 31. The blemish word sequence signal, which contains the successive 8-bit blemish words, is received on lines 185 from the demultiplexer 32, and the successive words it contains are clocked into the scan storage register by the blemish word clock signal on line 177.

The scan storage register 189 provides two parallel 8-bit outputs, the first output being on lines 203 and comprising the blemish word sequence signal delayed by 256 blemish word times (i.e. delayed by one 360° scan by the four segmental cameras 31), and the second output being on lines 205 and comprising the blemish word sequence signal delayed by 512 blemish word times (i.e. delayed by two 360° scans by the four segmental cameras). Thus, at any given time, the blemish word sequence signal on lines 185 and the scan storage register's first and second outputs on lines 203 and 205, respectively, contain blemish words corresponding to the same photodiode for three consecutive 360° scans.

6.2 Scan Select Circuit

Successive comparisons of blemish data words are accomplished by successively digitally dividing each blemish word by one half the sum (i.e. the average) of the two blemish words corresponding to the same photodiode for either the two immediately preceding scans or the two immediately subsequent scans. Each resultant quotient is a measure of the percentage rate of change of reflectance for the corresponding portion of the surface of the fruit being examined.

A substantially identical measure of the percentage rate of change of surface reflectance could be accomplished by successively dividing the blemish words corresponding to adjacent photodiodes within each scan. Typical photodiode arrays that are presently available commercially, however, suffer the drawback of having small voltage offsets between adjacent photodiodes. Such offsets would produce errors in the quotients generated by the division operation. In the preferred embodiment described above, on the other hand, where the division operation is performed with blemish words corresponding to the same photodiode only, these voltage offsets are substantially cancelled.

Figure 11:
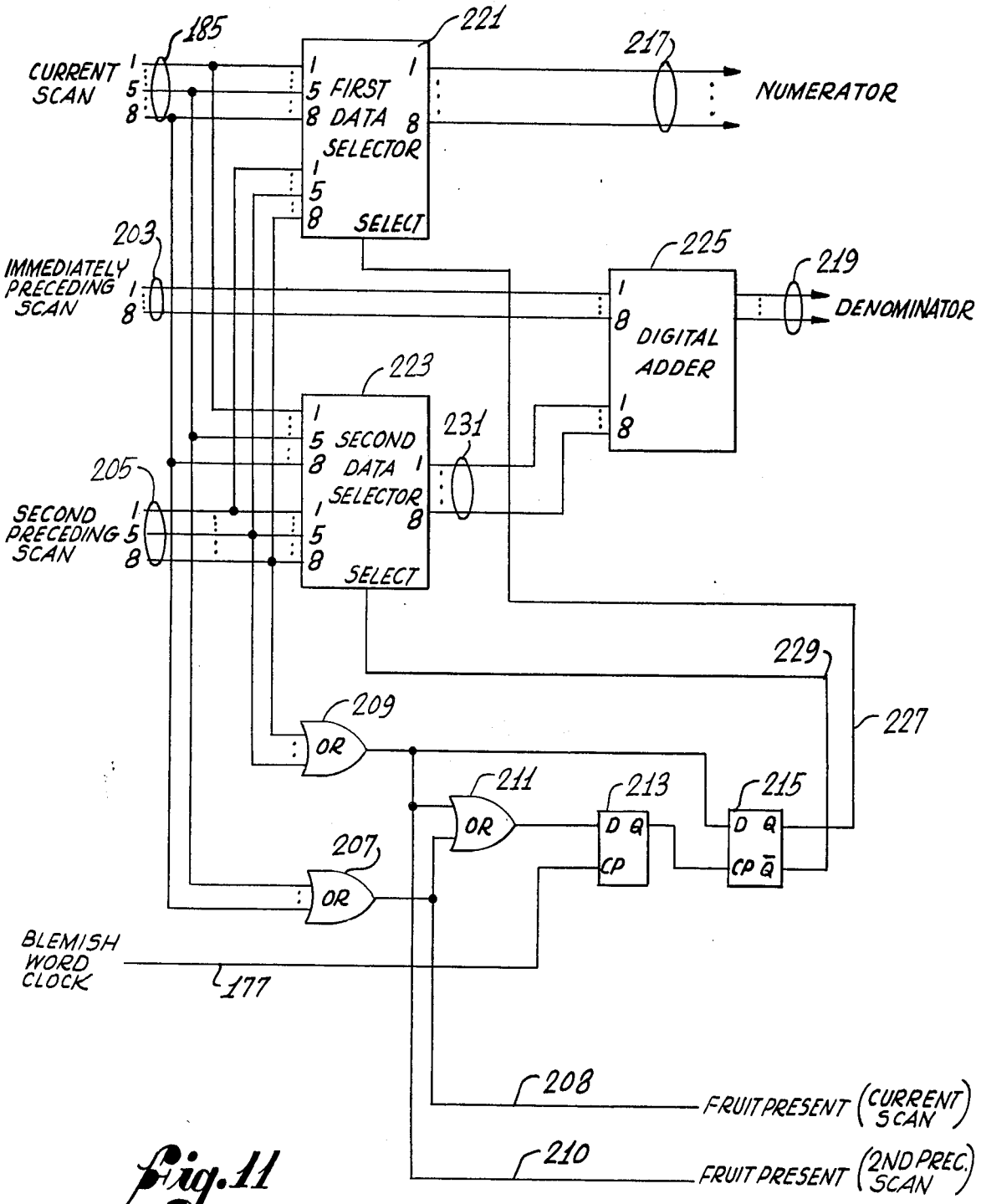
FIG. 11 is a simplified schematic diagram of the scan select circuit of the blemish detection circuitry of FIG. 7.

The scan select circuit 191, shown in detail in FIG. 11, formats the successive blemish words into appropriate numerators and denominators for processing by the digital divider 193. As shown in FIG. 7, each parallel 8-bit blemish word that is received by the scan storage register 189 on lines 185 is also transmitted to the scan select circuit 191. Simultaneously, the words corresponding to the same photodiode for the previous two scans are transmitted over lines 203 and 205, respectively, to the scan select circuit. Accordingly, this circuit 191 receives the three parallel blemish words, and provides an appropriate sequence of numerators and denominators to the digital divider 193.

It is desirable that the digital divider 193 should never divide by a number near zero, i.e., by a blemish word having eight successive zeros, as would result if a photodiode had no light incident on it. Dividing by a number near zero creates a likelihood that the quotient will exceed the limits of the divider and that an erroneous output will result. At those times when a fruit is just entering the fields of view of the photodiode arrays 63, the current blemish words will likely be non-zero, while those for the preceding two scans, which correspond to the black background area of the examining region, will be at or near zero. Thus, if the digital divider 193 were to divide the blemish words of the current scan by the average of those of the preceding two scans, erroneous output quotients could be generated.

To alleviate this problem, the scan select circuit 191 insures that the successive denominators provided to the digital divider 193 never correspond to the black background area. When the first half of a fruit is being examined, the numerators are formed by the successive blemish words from the second preceding 360° scan, and the denominators are formed by the averages of the successive blemish words from the current 360° scan and the immediately preceding 360° scan. On the other hand, when the last half of the fruit is being examined, the numerators are formed by the successive blemish words from the current 360° scan, and the denominators are formed by the averages of the successive blemish words of the preceding two 360° scans.

In this manner, whenever any portion of the fruit is being examined, the denominator provided to the divider 193 will always be based on blemish words corresponding to segments located furthest from an edge of the fruit. Accordingly, the scan select circuit 191 minimizes the likelihood of having a denominator near zero, and thus of having erroneous output quotients from the divider 193. Each such quotient, then, is an accurate measure of the rate of change of surface reflectance for a particular portion of the fruit.

As shown in FIGS. 7 and 11 the scan select circuit 191 receives the blemish word sequence signal on lines 185 from the demultiplexer 32, and receives the sequences of blemish words for the immediately preceding 360° scan and the second preceding 360° scan on lines 203 and 205, respectively, from the scan storage register 189. For each camera scan, the scan select circuit makes a word-by-word comparison of blemish words from the current 360° scan with blemish words from the second preceding 360° scan, detecting which of the two scans is first to include a blemish word corresponding to a segment of the fruit surface, as contrasted with a portion of the black background area.

This comparison is accomplished using first, second and third OR gates 207, 209 and 211, respectively, and first and second D-type flip-flops 213 and 215, respectively. The four most significant bits in the blemish words of the current scan are successively OR'ed in the first OR gate 207, and similarly, the four most significant bits for the words of the second preceding scan are OR'ed in the second OR gate 209. It will be appreciated that the output of OR gates 207 and 209 on lines 208 and 210, respectively, are "fruit present" signals which are a logical "1" whenever the corresponding blemish words correspond to segments of the surface of the fruit being examined. These signals on lines 208 and 210 are applied as inputs to OR gate 211, the output of which is connected to the D input terminal of flip-flop 213.

As soon as the output of either of the OR gates 207 or 209 goes to a logical "1", a logical "1" is clocked into the first flip-flop 213 by the blemish word clock signal on line 177. The Q output of the first flip-flop 213, in turn, clocks the output of the second OR gate 209 into the second flip-flop 215. Thus, if the particular camera scan from the second preceding 360° scan was the first to contain a word corresponding to a segment of the fruit, when the second half of the fruit is being examined and the Q output of the second flip-flop 215 is a logical "1". On the other hand if the present camera scan is first to continue a word corresponding to a segment of fruit, the first half of the fruit is being examined and the Q output of the second flip-flop 215 is a logical "0". The process is repeated for each camera scan.

In accordance with the outcome of the above comparison, the scan select circuit 191 generates, successively, the appropriate numerators and denominators to be provided to the digital divider 193 on lines 217 and 219, respectively. This is accomplished using first and second digital data selectors 221 and 223 and a digital adder 225. Each of the data selectors 221 and 223 comprises a pair of quadruple 2-line to 1-line data selector multiplexers, such as Part No. 74 LS 157, manufactured by Texas Instruments of Dallas, TX.

Each of the data selectors 221 and 223 receives two parallel 8-bit data inputs, one being the successive blemish words for the current 360° scan, on lines 185 from the demultiplexer 34, and the other being the successive blemish words for the second preceding 360° scan, on lines 205 from the scan storage register 189. The Q output of the second flip-flop 215 is provided on line 227 to the SELECT input of the first data selector 221, while the corresponding $\overline{Q}$ output is provided on line 229 to the SELECT input of the second data selector 233.

If the Q output of the second flip-flop 215 is a logical "1" (and the $\overline{Q}$ output a logical "zero"), then the first data selector 221 automatically selects the blemish word data for the current 360° scan and outputs such parallel data on its output terminals, and the second data selector 223 automatically selects the blemish word data for the second preceding 360° scan and outputs such parallel data on its output terminals. On the other hand, if the Q output of the second flip-flop is a logical "zero" (and the $\overline{Q}$ output a logical "1"), then the first data selector outputs the blemish word data for the second preceding 360° scan, and the second data selector outputs the blemish word data for the current 360° scan.

The output of the second data selector 223 is transmitted over lines 231 to a first set of input terminals on the digital adder 225, while the successive blemish words for the immediately preceding 360° scan are transmitted over lines 203 from the storage register 189 to a second set of input terminals on the adder. The adder arithmetically sums the two parallel 8-bit inputs, providing a parallel 8-bit data output and a CARRY output. The seven most significant bits of the data output in combination with the CARRY output, constitute a sequence of 8-bit words, each of which is one half the sum (i.e. the average) of the corresponding two 8-bit blemish words received by the adder. It will be appreciated that use of the CARRY output and the seven most significant bits of the sum is effectively shifting the sum one bit to the right, which is a divide-by-two operation.

The output of the first data selector 221 on lines 217 forms the successive numerators for processing by the digital divider 193. The seven most significant output bits, along with the CARRY output, of the adder 225, on lines 219, form the successive denominators for processing by the divider 193.

6.3 Digital Divider

The digital divider 193 divides each of the successive numerators received on lines 217 by the corresponding denominators received on lines 219, to obtain a sequence of quotients that measure the rate of change of reflectivity of the surface of the fruit being examined. The blemish word clock signal on line 177 is used by the divider 193 to control its sequence of operation. The divider output is a parallel 9-bit quotient sequence signal on lines 233.

The quotient sequence signal comprises nine parallel bits, with the most significant bit representing $2^1$, and the least significant bit representing $2^{-7}$. Since the quotient is normally about 1.0, and at the fruit edges, less than 1.0, the divider capacity of 3.99 is rarely exceeded. The digital divider 193 can be readily constructed using conventional design techniques described in many handbooks on digital circuit design, such as *Fairchild TTL Applications Handbook,* published by Fairchild Camera and Instrument Corporation of Mountain View, CA, 1973.

6.4 High Pass Filter

Figure 12:
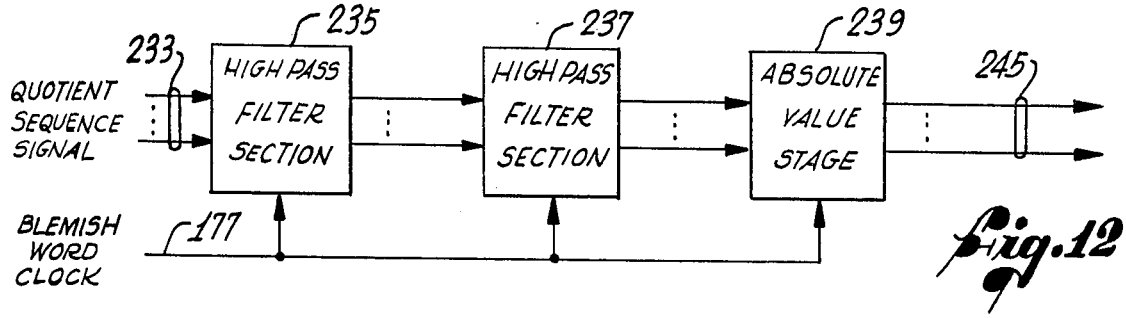
FIG. 12 is a more detailed block diagram of the high pass filter of the blemish detection circuitry of FIG. 7.
Figure 13:
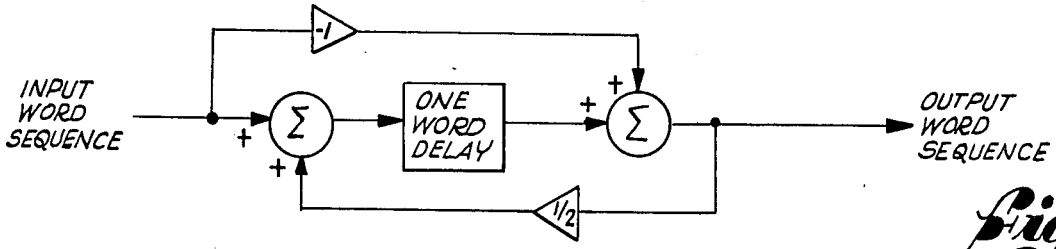
FIG. 13 is a simplified flow diagram of one filter section of the high pass filter of FIG. 11.

The digital high pass filter 195, shown in detail in FIGS. 12 and 13, receives the quotient sequence signal on lines 233 and substantially eliminates the constant and slowly varying portions of the signal, particularly those caused by the curvature of the fruit surface being examined. The illustrative filter comprises a pair of identical cascaded one-pole filter sections, FIG. 13 showing one such section. Conventional two's complement binary coding is used, so that negative numbers can be conveniently handled. The filter sections provide an output comprising eight parallel bits of magnitude data and one bit of sign data, the latter indicating whether the magnitude is positive or negative. These filter sections can also be implemented using conventional digital circuitry techniques, such as described in the aforementioned *Fairchild TTL Applications Handbook.*

It will be appreciated that many high-pass filter designs can be used to achieve the goal of eliminating constant and slowly varying portions of the quotient sequence signal. The presently preferred filter design, provides sufficient filtering to substantially eliminate the undesired portions of the input signal, yet it can be readily implemented without undue circuit complexity.

Following the two cascaded filter sections in the high-pass filter 195, is an absolute value stage 239 for converting the negative portions of the filtered signal into positive portions of a corresponding magnitude. In this manner, the detection of a rapid decrease in surface reflectivity is afforded the same weight as the detection of an equally rapid increase in surface reflectivity. The output terminals of the absolute value stage 239 form the high-pass filter output signal on lines 245.

The absolute value stage 239 comprises a pair of quad 2-input exclusive OR gates. The eight parallel bits of magnitude data from the filter sections are supplied individually to one set of inputs on the eight games, while the sign bit from the filter sections is supplied to all eight of the second set of inputs. In this manner, if the sign bit is a "zero" (indicating a positive magnitude)

then the outputs of the eight exclusive-OR gates will correspond to the eight parallel bits of magnitude data from the filter sections. On the other hand, if the sign bit is a "1" (indicating a negative magnitude) then the outputs of the eight exclusive-OR gates will correspond to the complement (i.e. the inverse, in two's complement binary coding) of the eight parallel bits of magnitude data from the filter sections.

6.5 Blemish On/Off Timing Circuit

The blemish on/off timing circuit 197 (FIG. 7) generates a blemish timing signal on line 247, which enables the blemish integrator 199 to sum the successive filtered digital quotients supplied on lines 245 from the high-pass filter, to obtain a measure of total blemish on the surface of each fruit being examined. The blemish timing signal is a logical "1", thereby allowing the integrator 199 to operate, only when segments of the fruit surface, as contrasted with segments of the black background area of the examining region 47, are being examined.

The blemish timing signal remains in the logical "zero" state, however, when segments of the fruit surface at or near the edges of each fruit image, are being examined. Because such segments are viewed at oblique angles, and the corresponding blemish words are not completely accurate measures of the reflectivity of the fruit surface, it is desirable to treat such segments near the fruit edges in the same manner as the background area. There is sufficient overlap in the portions of the fruit surface viewed by each segmental camera 31 that the elimination of three blemish words corresponding to the fruit edges in each camera scan, is not significant. All or nearly all of the portions of the fruit surface corresponding to eliminated blemish words, are also viewed by an adjacent segmental camera 31, and are not normally eliminated from the camera scan for that camera.

The blemish timing signal on line 247 is generated by detecting, for each camera scan, the image "envelope" of a fruit being examined (i.e. the timing of the blemish words corresponding to segments of the surface of the fruit, as contrasted with the black background area), and by then eliminating three blemish word times from both the leading and trailing edges of the envelope. Additionally, the blemish on/off timing circuit 197 includes circuit means for differentiating between a blemish and the trailing edge of a fruit image envelope, so that the blemish timing signal on line 247 remains in the logical "1" state even when a nonreflective surface blemish is being examined. Thus, the blemish integrator 199 remains enabled to sum the successive blemish quotients on lines 245, until the actual trailing edge of the fruit image is reached.

The blemish timing signal on line 247 is generated using the "fruit present" signals on lines 208 and 210, received from the scan select circuit 191. It will be recalled that the fruit present signal is in the logical "1" state only when the corresponding blemish word corresponds to a segment of a fruit surface, as contrasted with the black background area. The fruit present signal on line 208 corresponds to the current 360° scan, while the signal on line 210 corresponds to the second preceding 360° scan. The occurrences of non-reflective blemishes, however, cause the fruit present signals to have "dropouts", just as though the trailing edge of the fruit had been reached and the black background area was being examined. The blemish timing signal corresponds to the fruit present signal, but with the dropouts due to blemishes removed and with three blemish word periods deleted from all leading and trailing edges of the fruit image in each camera scan.

Figure 14:
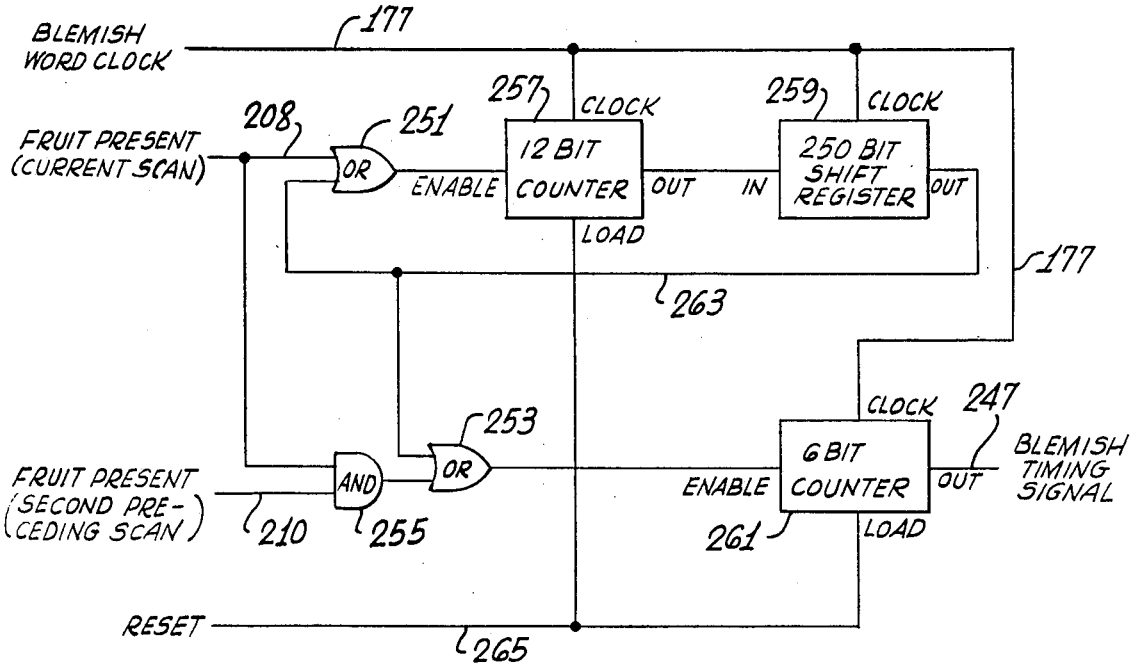
FIG. 14 is a simplified schematic diagram of the blemish on/off timing circuit of the blemish detection circuitry of FIG. 7.

As shown in detail in FIG. 14, the blemish on/off timing circuit 197 comprises first and second OR gates 251 and 253, respectively, an AND gate 255, a 12-bit counter 257, a 250-bit shift register 259 and a 6-bit counter 261.

The circuit 197 initially generates, for each successive camera scan, a partial envelope signal on line 263, which defines an envelope of the fruit image but with six blemish word periods deleted from both its leading and trailing edges. This partial envelope signal is generated in a recursive fashion, by successively OR'ing in the first OR gate 251 the fruit present signal for the current scan, received on line 208, with the partial envelope signal for the corresponding camera scan of the previous 360° scan (i.e. the prior scan for the same segmental camera 31). Thus, the output of the OR gate 251 is a logical "1" whenever the fruit present signal is a logical "1", and is held in that state by the partial envelope signal even if a non-reflective blemish causes a dropout in the fruit present signal.

The output of the OR gate 251 is connected to the ENABLE input of the 12-bit counter 257, which for each camera scan deletes the first twelve blemish word periods of logical "1" state from the OR gate 251 output. The counter 257 produces zero-state outputs so long as its ENABLE input is zero, and continuous to produce a zero output for the first twelve 1's applied to its ENABLE input, after which the output signal follows the ENABLE input signal. The counter 257 is reset between successive camera scans by a reset signal on line 265 from the timing unit B 171. The output of the counter 257 is connected to the shift register 259, which delays the output by 250 blemish word periods, to produce the partial envelope signal on line 263. It will be appreciated that the delay of 250 blemish word periods effectively shifts the envelope signal out of phase by six periods, since there are 256 periods in a complete 360° scan. The envelope on line 263 therefore has its leading and trailing edges shortened by six periods.

The partial envelope signal on line 263, in addition to being connected to one input terminal of the first OR gate 251 to form the partial envelope signal for the next 360° scan, is connected to one input terminal of the second OR gate 253. Connected to the second input terminal of the OR gate 253 is the output of the AND gate 255, which ANDs the two fruit present signals (present scan and second previous scan) received on lines 208 and 210, and produces an output signal which is the shorter of the two input envelopes, and includes dropouts due to blemishes. The output of the second OR gate 253, then, represents an envelope of the shorter of 1) the fruit image for the present camera scan and 2 the fruit image for the corresponding camera scan for the second previous 360° scan, but with dropouts due to non-reflective blemishes being deleted.

The output of the second OR gate 253 is connected to the ENABLE input of the 6-bit counter 261, which, for each camera scan, deletes the first six blemish word times of logical "1" from the OR gate 253 output, thereby forming the blemish timing signal on line 247. The 6-bit counter 261 functions in the same way as the 12-bit counter 257. It provides a zero output when the ENABLE input is zero, and maintains a zero output for the first six "one" inputs, after which the output signal follows the input signal. This has the effect of deleting the first six "ones" from the leading edge of the envelope signal. An inherent property of the high-pass filter 195 is that it delays the output by three blemish word periods. Accordingly, the phase relationship between the blemish timing signal on line 247 and the filter output signal on lines 245 is such that the blemish integrator 199 is disabled for the first three and the last three blemish word times of each camera scan.

6.6 Blemish Integrator

The blemish integrator 199 (FIG. 7) sums together the successive digital words of the high-pass filter output signal to derive a blemish count signal on lines 275 that is a measure of the total blemish on the surface of each fruit. The summing activity is enabled by the blemish timing signal on line 247, which is in the logical "1" state only when the high-pass filter output signal contains data based on segments of the fruit surface, as contrasted with portions of the black background area. The integrator 199 is reset to the logical "zero" state by a reset signal on line 159 from timing unit A 95 (FIG. 5), immediately prior to the examination of each fruit.

The blemish integrator 199 may be implemented in any of a variety of forms. For example, it may include an 8-bit adder having an overflow signal connected to increment an up/down counter, the several stages of which supply the output signals on lines 275. As will be appreciated from the following descriptive section, the up/down counter may be decremented to compensate for erroneous blemish indications.

It will be appreciated that the examination of fruit that appears unblemished, will sometimes result in a non-zero blemish measurement by the blemish integrator 199. This is caused by the detection of stem and blossom ends, by the fruit surface texture, and by random noise in the system. It is preferable, however, that the blemish detection circuitry 35 compensate for these factors and provide a blemish measurement that is nominally zero for unblemished fruit. This is accomplished by a normalizer circuit 295.

6.7 Normalizer Circuit

The normalizer circuit 295 (FIG. 7) generates a blemish normalizer pulse sequence on line 297 that is transmitted to the blemish integrator 199, for decrementing the blemish count signal on lines 275. The frequency of the pulse sequence on line 297 is manually selectable, and the pulse sequence is "ENABLED" by the blemish timing signal on line 247, i.e. only when segments of the fruit surface are being examined. By an empirical selection of the frequency of the pulse sequence, the blemish count signal on lines 275 from the blemish integrator 199 can be made to be near zero for unblemished fruit. Higher counts are indicative of fruit having greater surface blemish.

It will be understood by those of ordinary skill in the art that the normalizer circuit 295 can be constructed using known design techniques. For example, the normalizer 295 can be merely a binary counter for frequency-dividing input pulses supplied from the blemish word clock on line 197, and for providing a string of output pulses at a controllable rate to the blemish integrator 199, where the pulses are utilized to diminish the overall blemish indication, such as be decrementing the UP/DOWN counter in the blemish integrator.

6.8 Size Detection Circuit

The size detection circuitry 37 (FIG. 7) generates a size count signal on lines 311 that is a measure of the size of each fruit being examined. The circuitry counts the number of segments in the total reflective surface of each fruit by counting the number of blemish word periods that the blemish timing signal on line 247 is in the logical "1" state. The circuitry 37 is reset to the logical "zero" state by the reset signal on line 159, immediately prior to the examination of each fruit.

It will be understood by those of ordinary skill in the art that the size detection circuitry 37 is basically a multistage binary counter, and that it can be readily constructed using known design techniques.

7. Color Detection Circuitry

Figure 15:
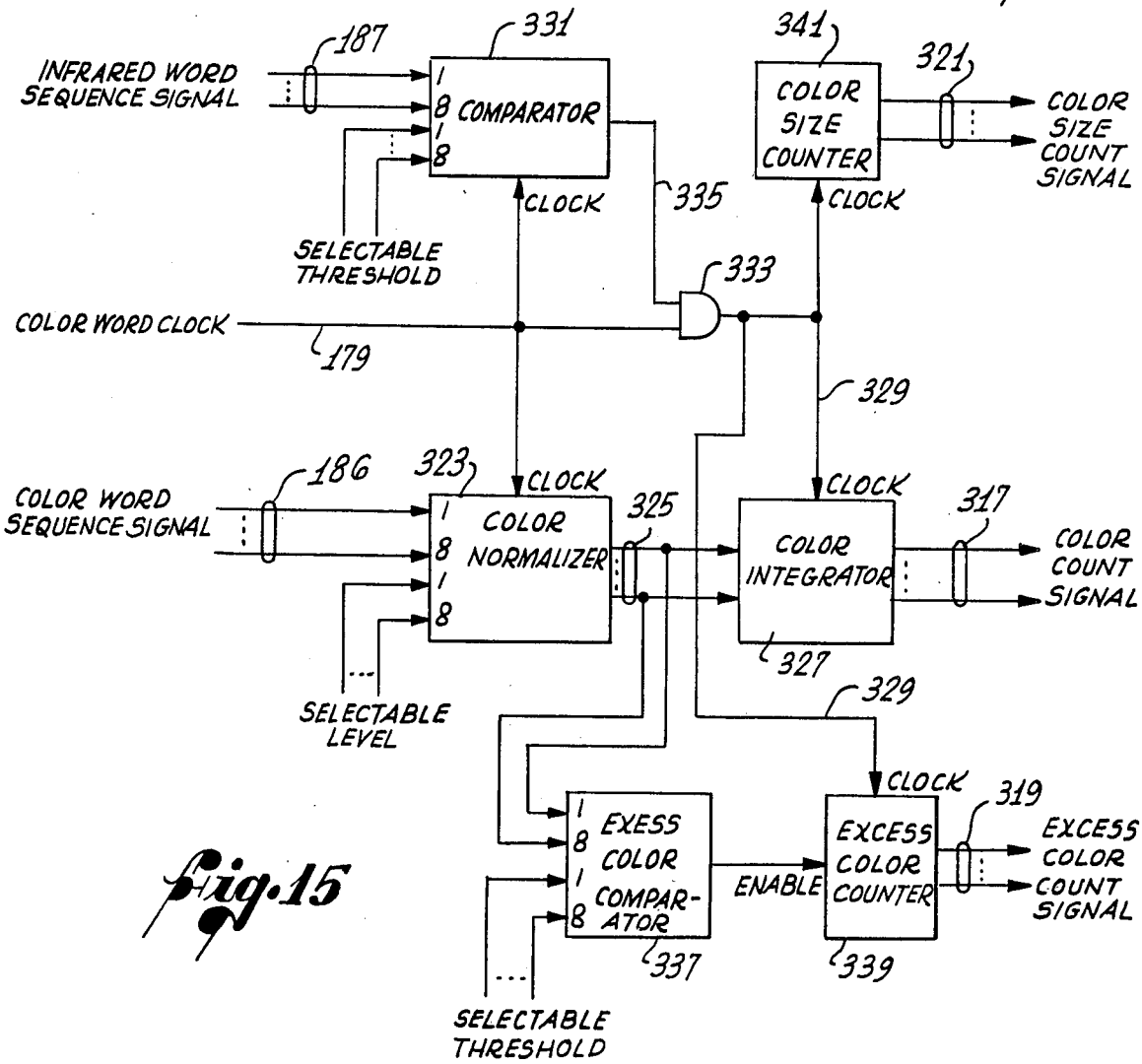
FIG. 15 is a more detailed block diagram of the color detection circuitry of the apparatus of FIG. 4.

The color detection circuitry 39, as shown in detail in FIG. 15, receives the demultiplexed color word sequence signal on lines 186 and infrared word sequence signal on lines 187 from the demultiplexer 34 (FIG. 3B). The color detection circuitry analyzes the successive words of each signal to obtain measures of the surface color of each fruit, and to obtain an additional measure of the size of each fruit. The circuitry 39 generates (1) a color count signal on lines 317, which is derived by summing together normalized color ratio words for all of the surface strips on each of the successive fruit, (2) an excess color count signal on lines 319, which is a count of the number of surface strips on each of the successive fruit for which a selectable color level is exceeded, and (3) a color size count signal on lines 321, which is a count of the number of surface strips on each of the successive fruit.

As previously described, the successive color ratio words received on lines 186 are each derived by dividing the output of a red phototransducer 65 by the output of the corresponding infrared phototransducer 67. The magnitude of the color ratio word is a measure of color or ripeness of the corresponding strip on the surface of the fruit being examined.

It is preferable that the color count signal on lines 317, which is generated by the color detection circuitry and which is a measure of the surface color of each fruit, be normalized so that it is near zero for ripe fruit, with greater magnitudes for green and re-greened fruit. Normalizing is accomplished by a color normalizer circuit 323 that successively subtracts each color ratio word received, on lines 186, from a manually selectable reference level. The color normalizer circuit 323 is clocked by the color word clock signal on line 179, which includes one pulse for each successive color ratio word. It outputs a normalized color word sequence signal on lines 325.

The successive normalized color words on lines 325 are summed together in a color integrator 327, to generate the color count signal on lines 317. The integrator 327 is clocked by a clock signal on line 329. As will be further explained, this clock signal includes a pulse for each color word corresponding to a surface strip of a fruit, as contrasted with the black background area of the examining region 47.

The clock signal on line 329 is derived from an AND gate 333 which has one input connected to the color word clock on line 179 and a second input connected to the output of a comparator 331. The comparator 331 compares each of the successive infrared words received on lines 187 to a suitable manually selectable threshold value, to determine whether each infrared word, and thus its corresponding color ratio word, correspond to a surface strip of a fruit being examined or to the black background area. If the threshold is exceeded, it is assumed that a fruit is being examined and the output of the comparator 331 will be a logical "1", thereby enabling the clock signal on line 329 from the AND gate 333. The clock signal on line 329 is therefore equivalent in timing to the color word clock signal on line 179, but is enabled only duing examination of a fruit, as determined in the comparator 331.

An excess color comparator 337 and an excess color counter 339 generate the excess color count signal on lines 319. The excess color count indicates for each fruit the number of normalized color ratio words, on lines 325, whose magnitudes exceed a selectable reference threshold. The excess color counter 339 is also clocked by the clock signal on line 329, which, it will be recalled, includes a pulse for every color ratio word corresponding to a surface strip of a fruit. These two circuits can be utilized, for example, to determine the proportion of a fruit which is greener than a predetermined level.

A color size counter 341 counts the number of separate surface strips in the total reflective surface of each fruit, to produce the color size count signal on lines 321. The counter 341 accomplishes this by counting the successive clock pulses in the clock signal on line 329, which contains one pulse for every infrared word that corresponds to a surface strip of the fruit being examined.

The color integrator 327, the excess color counter 339 and the color size counter 341 are all reset to the logical "zero" state by the reset signal on line 159 (omitted for clarity in FIG. 15), immediately prior to the examination of each fruit. In this manner, the counts for each fruit are independent of the counts for fruit previously examined.

It will be understood by those of ordinary skill in the electronics art that the various circuit elements of the color detection circuit 39, described above, can be readily constructed using commercially available digital integrated circuits in accordance with known design techniques. More specifically, the circuit elements comprise comparators, adders and counters. The comparators 331 and 337 are conventional digital comparators, the counters 341 and 339 are conventional binary counters, the normalizer 323 is a digital adder, and the color integrator 327 is basically an accumulating adder.

8. Fruit Grading

As previously described, the blemish detection circuitry 35 produces a digital blemish count of the total surface blemish of each of the fruit being examined, and a digital size count signal on lines 311, which is a successive count of roughly the number of surface segments of each fruit. Simultaneously, the color detection circuitry 39 produces a digital color count signal on lines 317, which is a successive summation of all the color ratio words for each fruit, a digital excess color count signal on lines 319, which is a successive count of the number of surface strips on each fruit for which the corresponding color ratio word exceds a selectable threshold, and a digital color size count signal on lines 321, which is a successive count of the number of surface strips for each fruit.

The aforementioned five digital count signals are provided to the computer 40, which analyzes the respective counts for each fruit to determine the grade category to which the fruit properly belongs. The computer 40 receives a sample signal on line 343 (shown in FIG. 4) from the timing unit B 171, for triggering the sampling by the computer of the five count signals. Each of the successive pulses in the sample signal occurs immediately after a fruit has passed completely through the examining region 47, and immediately prior to a corresponding pulse in the reset signal on line 159, which is used by the system to reset the respective counts to zero. At the time each sample pulse is received, then, each of the five count signals will be a measurement derived after the entire surface of a fruit has been examined.

Preferably, the computer 40 normalizes the successive counts of the blemish count signal received on lines 275 by dividing them by the corresponding segmental counts of the segmental count or fruit size signal received on lines 311. This results in a succession of blemish measures which respesent the degree of the surface blemish on the fruit, normalized for size differences. It will be apparent that this normalization could just as readily be performed by a hard-wired digital divider circuit.

Similarly, it is preferable to utilize the computer 40 to normalize the successive counts of the color count signal received on lines 317 and the excess color count signal received on lines 319, by dividing them by the corresponding surface strip counts of the color count signal received on lines 321. This results in a succession of measures of the average color of the fruit and of the proportion of the surface area of each fruit having a color exceeding a predetermined selectable level.

The computer 40 is programmed with thresholds defining the blemish, size and color limits of the various grade categories into which the fruit are to be graded and sorted. The computer automatically compares the size count and the normalized blemish, color and excess color counts for each fruit to these thresholds and determines the grade category in which the fruit properly belongs.

While the computer is performing the above-described operations, the fruit 21 are being transported by the second conveyor 29 from the examining region 47 to the sorting station 28. Each of the solenoids 27 located at the sorting station 28 corresponds to a separate grade category. When a solenoid 27 is actuated, it tilts the portion of the conveyor 29 that is immediately above it and thereby discharges any fruit thereon into a receive for a particular grade of fruit.

The computer 40 is also programmed with timing information which indicates the time that elapses while the fruit moves from the examining region 47 to each of the solenoids 27 in the sorting station 28. At the proper times, the computer outputs pulses on lines 345 to the appropriate solenoids, to discharge the fruit in accordance with the grade determinations it has made.

A computer is used to accomplish the abovedescribed grading operations, because it is ordinarily readily reprogrammable, thereby permitting quick adaptation of the system to accommodate differences in fruit types and differences in grading categories. Such differences in grading categories are generally due to changes in the markets to which the fruit are to be directed, and to variations in the fruit related to successive stages of the growing season.

Figure 16:
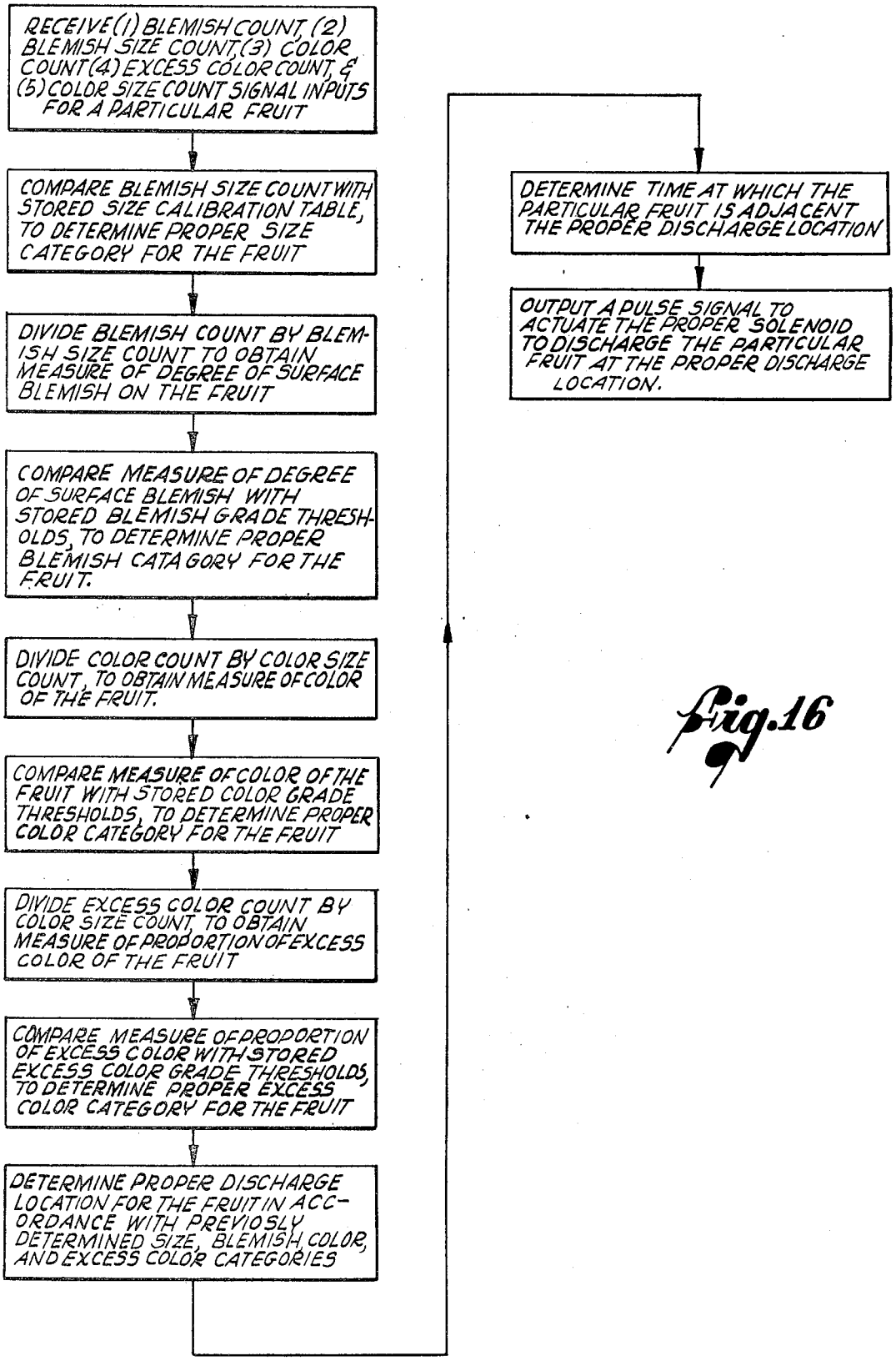
FIG. 16 is a flowchart showing, in simplified form, the operational steps performed by a computer in processing blemish, color and size measurements derived by apparatus of the present invention.

It will be appreciated that the specific program for the computer 40 will depend on the selected fruit grading criteria for a particular situation. The computer may utilize the derived input parameters relating to blemish, size and color in any desired manner to sort and grade the fruit. An example of a suitable computer program flowchart, in simplified form, is shown in FIG. 16.

From the foregoing, it should be apparent that the present invention provides a new and improved method and apparatus for automatically grading and sorting fruit according to size, surface blemish and surface color. The apparatus utilizes a plurality of cameras for sequentially examining and generating reflectance readings for a plurality of discrete areas on the fruit surface. The readings are suitably analyzed and combined to derive overall measurements of the size, blemish and color of fruit. The fruit is then discharged to appropriate receivers in accordance with the measurements. The system is highly effective in providing fast, reliable and repeatable fruit grading, while providing flexibility to allow frequent modifications to the grading categories.

While a specific form of the invention has been illustrated and described, it should be apparent that various modifications and variations can be made without departing from the spirit and scope of the invention. Accordingly, it is not intended that the invention be limited, except as by the appended claims.

We claim:

1. Apparatus for measuring the size of the surface of an article, said apparatus comprising:

means defining an examining region;

means operable when the article is disposed in said examining region for illuminating the surface of the article;

means for sensing light reflected from the surface and producing a plurality of light intensity measurements, each of said measurements corresponding to the intensity of light reflected from a discrete segmental area on the surface, each of said segmental areas having substantially the same predetermined size, the segmental areas together forming substantially the entire surface of the article; and means for receiving the plurality of light intensity measurements and counting the number of segmental areas on the surface, thereby producing a measure of the size of the surface.

2. Apparatus as defined in claim 1, wherein:

said examining region is substantially planar;

said apparatus further includes means for moving the article through said examining region;

said sensing means is operable to produce the plurality of light intensity measurements in a sequential fashion.

3. Apparatus as defined in claim 1, further including:

means for moving a plurality of articles in a sequential fashion through said examining region, whereby a separate measure of surface size is produced for each article.

4. Apparatus as defined in claim 3, further including:

means for sorting the articles in accordance with the measures of surface size.

5. Apparatus for measuring the size of the surface of an article, said apparatus comprising:

means defining a substantially planar examining region;

means for moving the article through said examining region;

means operable when the article is disposed in the examining region for illuminating the surface of the article;

means disposed around the periphery of said examining region for scanning the region in a repetitive fashion, whereby as the article is moved through the examining region, separate measurements of the circumferences of a plurality of unique circumferential swaths on the surface of the article are produced; and means for summing together the plurality of circumference measurements, to produce a measure of surface size.

6. Apparatus as defined in claim 5, wherein said scanning means includes:

a plurality of phototransducers disposed around the periphery of said examining region, each phototransducer for measuring the intensity of light received from a discrete portion of said examining region;

means for repetitively reading each of said phototransducers in a sequential fashion, to produce a plurality of groups of light intensity measurements, each of said groups including one light intensity measurement from each of said phototransducers and including measurements corresponding to a plurality of discrete segments of the surface of the article, said segments forming a unique circumferential swath on the surface of the article;

processing means for determining whether or not each of said light intensity measurements corresponds to a segment of the surface of the article; and means for counting the number of light intensity measurements in each group of measurements that correspond to portions of the surface of the article, thereby producing said plurality of circumference measurements.

7. Apparatus as defined in claim 6, wherein:

said processing means includes a comparator for comparing each of said light intensity measurements to a predetermined threshold.

8. Apparatus as defined in claim 7, wherein:

said processing means further includes means for distinguishing between light intensity measurements that correspond to blemished portions of the surface of the article and light intensity measurements that correspond to portions of the examining region not occupied by the article, whereby the presence of blemishes on the surface of the article does not affect the circumference measurements that are produced.

9. Apparatus as defined in claim 8, further including:

means for moving a plurality of articles in a sequential fashion through said examining region, whereby a separate measure of surface size is produced for each article.

10. Apparatus as defined in claim 9, further including:

means for sorting the articles in accordance with the measures of surface size.

11. A method for measuring the size of the surface of an article, said method comprising the steps of:

moving the article through an examining region;

illuminating the surface of the article when the article is disposed in said examining region;

sensing light received from said examining region and producing a plurality of light intensity measurements, each of said measurements corresponding to the intensity of of light received from a discrete portion of the examining region, each of said portions being of substantially the same size, whereby as the article is moved through the examining region, a plurality of measurements of the intensity of light reflected from an equal number of discrete, segmental areas on the surface of the article are produced, the segmental areas together forming substantially the entire surface of the article; and counting the number of separate light intensity measurements corresponding to portions of the surface of the article, thereby producing a measure of the size of the surface.

12. A method as defined in claim 11, wherein said examining region is substantially planar and wherein said method further includes the steps of:

moving a plurality of articles in a sequential fashion through said examining region, whereby a separate measure of surface size is produced for each article; and sorting the articles in accordance with the measures of surface size.

13. A method as defined in claim 11, wherein said step of counting includes the steps of:

comparing each of said light intensity measurements to a predetermined threshold; and determining that a light intensity measurement corresponds to a portion of the surface of the articles whenever the measurement exceeds the threshold.

14. Apparatus for grading and sorting a plurality of articles according to the sizes of the surfaces thereof, said apparatus comprising:

means defining a substantially planar examining region;

conveyor means for moving the plurality of articles in a sequential fashion through said examining region;

means operable when an article is disposed in said examining region for illuminating the surface of the article;

camera means disposed on the periphery of said examining region for scanning the examining region in a repetitive fashion, each of said scans producing a plurality of measurements of intensity of light received from a corresponding number of discrete segmental portions of said examining region, each of said segmental portions having substantially the same size, whereby as each article is moved through the examining region, substantially its entire surface area is scanned;

processing means for receiving each of the plurality of light intensity measurements and producing a count pulse whenever the corresponding segmental portion of the examining region is occupied by a portion of the surface of the article, said processing means including a comparator for comparing each of said light intensity measurements to a predetermined threshold;

means for counting the number of count pulses produced by said processing means for each article, to produce a measure of the size of the surface of the article; and means for sorting the articles in accordance with the measures of surface size.

* * * * *